US011456126B2

(12) United States Patent
Zheng et al.

(10) Patent No.: US 11,456,126 B2
(45) Date of Patent: Sep. 27, 2022

(54) ELECTRIC SWITCH

(71) Applicant: KEDU ELECTRIC CO., LTD., Zhejiang (CN)

(72) Inventors: Chunkai Zheng, Zhejiang (CN); Ziping Li, Zhejiang (CN); Bangran Huang, Zhejiang (CN); Shengjian Huang, Zhejiang (CN); Zhihao Chen, Zhejiang (CN)

(73) Assignee: KEDU ELECTRIC CO., LTD, Wenzhou (CN)

( * ) Notice: Subject to any disclaimer, the term of this patent is extended or adjusted under 35 U.S.C. 154(b) by 0 days.

(21) Appl. No.: 17/352,228

(22) Filed: Jun. 18, 2021

(65) Prior Publication Data

US 2021/0313124 A1 Oct. 7, 2021

(30) Foreign Application Priority Data

Nov. 27, 2020 (CN) ..... 202011359250.6

(51) Int. Cl.

| | |
|---|---|
| ***H01H 15/18*** | (2006.01) |
| ***H01H 5/06*** | (2006.01) |
| ***H01H 13/28*** | (2006.01) |
| ***H01H 9/20*** | (2006.01) |
| ***H01H 23/04*** | (2006.01) |
| ***H01H 23/20*** | (2006.01) |
| ***H01H 5/04*** | (2006.01) |
| ***H01H 15/00*** | (2006.01) |
| ***H01H 13/18*** | (2006.01) |

(52) U.S. Cl.

CPC ..... *H01H 9/20* (2013.01); *H01H 5/045* (2013.01); *H01H 5/06* (2013.01); *H01H 13/186* (2013.01); *H01H 13/28* (2013.01); *H01H 15/005* (2013.01); *H01H 15/18* (2013.01); *H01H 23/04* (2013.01); *H01H 23/20* (2013.01)

(58) Field of Classification Search

None

See application file for complete search history.

(56) References Cited

U.S. PATENT DOCUMENTS 4,006,333 A * 2/1977 Hults ..... H01H 3/001 200/437
4,121,069 A * 10/1978 Long ..... H01H 23/20 200/434

(Continued)

FOREIGN PATENT DOCUMENTS

CN 211125437 U 7/2020

*Primary Examiner* — Felix O Figueroa

(57) ABSTRACT

Provided is an electric switch, including a casing, an actuator, a movable contact frame, a snap-action resilient member, a lock mechanism, a signal switch and a contact switch. The actuator is capable of reciprocating along a first direction. The movable contact frame is provided with a retaining portion. The snap-action resilient member is arranged in the movable contact frame and is compressed by the actuator when the actuator moves. The lock mechanism includes two lock members which are capable of reciprocating in the mounting cavity along a second direction with the movement of the actuator, so as to lock or unlock the retaining portion. A brush of the electric switch is arranged on the movable contact frame. A movable contact of the contact switch is arranged on the movable contact frame.

11 Claims, 23 Drawing Sheets

(56) References Cited

U.S. PATENT DOCUMENTS

| | | | | |
|---|---|---|---|---|
| 4,149,053 | A * | 4/1979 | Long | H01H 3/001 200/DIG. 42 |
| 6,469,268 | B1 * | 10/2002 | Schaeffeler | H01H 15/18 200/405 |
| 6,664,490 | B2 * | 12/2003 | Kato | H01H 15/18 200/332.2 |
| 7,754,989 | B2 * | 7/2010 | Wong | H01H 23/20 200/522 |
| 10,199,185 | B2 | 2/2019 | Carrea | |
| 2019/0180958 | A1 | 6/2019 | Shimada | |

* cited by examiner

ELECTRIC SWITCH

CROSS-REFERENCE TO RELATED APPLICATIONS

This application claims the benefit of priority from Chinese Patent Application No. 202011359250.6, filed on Nov. 27, 2020. The content of the aforementioned application, including any intervening amendments thereto, is incorporated herein by reference in its entirety.

TECHNICAL FIELD

This application relates to switches for electrical appliances, in particular to an electric switch.

BACKGROUND

An electric switch is electrically powered and is an important trigger component in mechanical devices. Generally, it is configured to control the start and interruption of electrical devices. The electric switch includes a high-current contact switch and a low-current signal switch.

In the prior art, a snap-action mechanism is provided at a middle inside the electric switch, and a snap-action spring in the snap-action mechanism suddenly jumps to swing in the longitudinal direction. The snap-action spring of the snap-action mechanism not only provides a transverse action force to drive the action mechanism to operate, but also produces a large longitudinal component force, which is transmitted to a movable contact to generate positive pressure on the movable contact, thus causing the sliding parts of the action mechanism to suffer from severe wear.

In addition, after the snap-action movement of the spring, the transverse force increases as the swing angle increases, which will cause an increased impact force between contacts, resulting in an intensified snap action between the contacts. The arc generated between the contacts may easily burn the contacts. The snap-action spring experiences repeated twist and swing during the working process, which makes the snap-action spring prone to break due to fatigue, shortening the service life of the snap-action spring. Furthermore, the lock mechanism of the electric switch also moves longitudinally, and the pressure acts on the tail of the action mechanism, causing the action mechanism to swing up and down. Thus, a movable contact and a fixed contact rub up and down, which will shorten the service life of the contacts. With respect to the signal switch, the arrangement position is relatively limited, and the brush moves up and down, and has a complicated structure. Moreover, some additional components, such as stop frames, are needed.

SUMMARY

In order to solve the above technical solutions, the present disclosure aims to provide an electric switch which has a prolonged service life and may be arranged in diversified manners to properly utilize the space.

Technical solutions of the disclosure are described as follows.

In a first aspect, the present disclosure provides an electric switch, comprising: a casing;

wherein a mounting cavity is provided in the casing; and an actuator, a movable contact frame, a snap-action resilient member, a lock mechanism, a contact switch and a signal switch are provided in the mounting cavity;

the actuator is capable of reciprocating in the mounting cavity along a first direction;

the movable contact frame is provided with a retaining portion;

the snap-action resilient member is arranged in the movable contact frame, and is configured to be compressed by the actuator with movement of the actuator;

the lock mechanism comprises a first lock member and a second lock member; and the first lock member and the second lock member are configured to reciprocate in the mounting cavity along with movement of the actuator in a second direction to lock or unlock the retaining portion;

the signal switch comprises a brush and a circuit board; the brush is arranged on the movable contact frame, and the circuit board is arranged in the mounting cavity;

the contact switch comprises a movable contact and a fixed contact; the movable contact is arranged on the movable contact frame, and the fixed contact is arranged in the mounting cavity;

when the actuator is driven to move along the first direction, the first lock member locks the retaining portion, and the second lock member does not lock the retaining portion, and the snap-action resilient member is compressed by the actuator for energy storage; when the actuator is driven to continuously move along the first direction, the first lock member unlocks the retaining portion, and the snap-action resilient member produces a snap action to release energy to drive the movable contact frame to move, so that the brush is driven to slide on the circuit board to switch on/off the signal switch; at the same time, the movable contact is driven to move close to or away from the fixed contact, so that the movable contact is in contact with or separated from the fixed contact, allowing the contact switch to be switched on/off; during the movement of the movable contact frame, the second lock member locks the retaining portion.

In some embodiments, when the electric switch is in an initial state, the snap-action resilient member does not produce a snap action, and the first lock member and the second lock member do not play a locking role, and the actuator drives the movable contact frame to move in the first direction to allow the movable contact frame to contact the first lock member. At this time, the first lock member locks the movable contact frame. When the actuator continues to move in the first direction, the snap-action resilient member mounted in the movable contact frame is compressed by the actuator. At the same time, the actuator presses the first lock member to unlock the movable contact frame until a critical position of unlocking is reached. After the movable contact frame is unlocked, the snap-action resilient member is released instantaneously, and the movable contact frame moves quickly along the first direction to enable the signal switch and the contact switch to be switched on instantaneously. At this time, the second lock member locks the movable contact frame, which ensures the reliable connection of the contact switch, and eliminates the contact bounce and the poor contact caused by improper operation, effectively preventing the contacts from being burned and prolonging the service life of the electric switch. When the actuator is driven to move in the first direction to reset, the snap-action resilient member produces a reverse snap action to enable the electric switch to be switched off or on instantaneously. The snap-action force generated by the snap-action resilient member is a pure horizontal force, which is different from the diagonal snap-action force generated by the conventional electric switches. The signal switch may be arranged at a front end or a rear end of a bottom of the mounting cavity, so as to properly utilize the space.

In some embodiments, the actuator comprises a drive portion and an abutting portion connected to the drive portion; the abutting portion is capable of moving with the drive portion; the drive portion is inserted into the movable contact frame and moves with the actuator; the drive portion is capable of compressing the snap-action resilient member to allow the snap-action resilient member to store energy; and the abutting portion is capable of abutting against the first lock member or the second lock member to drive the first lock member or the second lock member to unlock the retaining portion.

In some embodiments, the snap-action resilient member comprises a first spring and a second spring which are respectively arranged at two sides of the drive portion; the first spring is able to be compressed by one side of the drive portion for energy storage, and the second spring is able to be compressed by the other side of the drive portion for energy storage.

In some embodiments, each of the first lock member and the second lock member comprises a lock portion, an unlock portion and a reset portion; one end of the reset portion abuts in the mounting cavity, and the reset portion is able to be compressed when subjected to a compression force exerted by the actuator in the second direction; when the compression force is removed, the reset portion has a reset force which is in the second direction and opposite to the compression force; the reset force allows the lock portion to move along the second direction and lock the retaining portion to limit the movement of the movable contact frame; the unlock portion is pressed by the actuator to overcome the reset force of the reset portion to allow the lock portion to be detached from the retaining portion.

In some embodiments, the electric switch further comprises a first terminal and a second terminal; the circuit board is mounted in the mounting cavity through the first terminal, and the fixed contact is mounted in the mounting cavity through the second terminal.

In some embodiments, the circuit board is electrically connected to the first terminal through a first resilient element; or the circuit board and the first terminal are riveted.

In some embodiments, the first terminal is provided with a first counterbore; in the first counterbore, the first terminal is connected to a first external conductor through a first locking screw; the second terminal is provided with a second counterbore; and in the second counterbore, the second terminal is connected to a second external conductor through a second locking screw.

In some embodiments, a first mounting slot and a second mounting slot are respectively arranged on two sides of the retaining portion of the movable contact frame; the brush is arranged in the first mounting slot, and the movable contact is arranged in the second mounting slot.

In a second aspect, the present disclosure provides an electric switch, comprising:

a casing;

wherein a mounting cavity is provided in the casing; and an actuator, a movable contact frame, a snap-action resilient member, a lock mechanism, a contact switch and a signal switch are provided in the mounting cavity;

the actuator is capable of reciprocating in the mounting cavity along a first direction;

the movable contact frame is provided with a retaining portion;

the snap-action resilient member is arranged in the movable contact frame, and is configured to be compressed by the actuator with movement of the actuator;

the lock mechanism comprises a first lock member and a second lock member; and the first lock member and the second lock member are configured to reciprocate in the mounting cavity with the movement of the actuator in a second direction to lock or unlock the retaining portion;

the signal switch comprises a brush and a circuit board; the brush is connected to the actuator, so that the actuator drives the brush to move; and the circuit board is arranged on the casing;

the contact switch comprises a movable contact and a fixed contact; the movable contact is arranged on the movable contact frame, and the fixed contact is arranged in the mounting cavity;

when the actuator is driven to move along the first direction, the first lock member locks the retaining portion, and the second lock member does not lock the retaining portion, and the snap-action resilient member is compressed by the actuator for energy storage; when the actuator is driven to continuously move along the first direction, the first lock member unlocks the retaining portion, and the snap-action resilient member produces a snap action to release energy to drive the movable contact frame to move; the movable contact is driven to move close to or away from the fixed contact, so that the movable contact is in contact with or separated from the fixed contact, allowing the contact switch to be switched on/off; the brush is driven by the actuator to move on the circuit board to switch on/off the signal switch; and during the movement of the movable contact frame, the second lock member locks the retaining portion.

In some embodiments, when the electric switch is in an initial state, the snap-action resilient member, the first lock member, and the second lock member do not play a locking role, and the actuator drives the movable contact frame to move in the first direction to allow the movable contact frame to contact the first lock member. At this time, the first lock member locks the movable contact frame. When the actuator continues to move in the first direction, the snap-action resilient member mounted in the movable contact frame is compressed by the actuator. At the same time, the actuator presses the first lock member to unlock the movable contact frame until a critical position of unlocking is reached. After the movable contact frame is unlocked, the snap-action resilient member is released instantaneously, and the movable contact frame moves quickly along the first direction to enable the signal switch and the contact switch to be switched on instantaneously. At this time, the second lock member locks the movable contact frame, which ensures that the reliable connection of the contact switch, and eliminates the contact bounce and the poor connection caused by improper operation, effectively preventing the contacts from being burned and prolonging the service life of the electric switch. When the actuator is driven to move in the first direction to reset, the snap-action resilient member produces a reverse snap action to enable the electric switch to be switched off/on instantaneously. The snap-action force generated by the snap-action resilient member is a pure horizontal force which is different from the diagonal force generated by the conventional electric switches. The signal switch may be arranged at a front end or a rear end of a bottom of the mounting cavity, so as to properly utilize the space.

In some embodiments, the casing is provided with a first groove, and a brush holder is provided in the first groove; the brush is arranged on the brush holder, and the actuator is provided with a second groove; the brush holder is inserted into the second groove, so that the brush holder is driven to move in the first groove through an inner side wall of the second groove.

In some embodiments, a hanger is provided in the first groove; and the circuit board is arranged at the casing through the hanger and is sealed by a resin.

The present disclosure will be described in detail below with reference to embodiments to make additional aspects and advantages of the present disclosure obvious and better understood.

Figure 1:
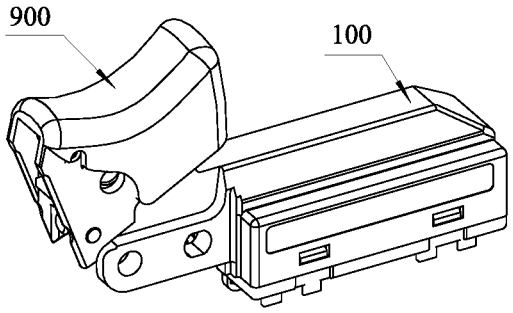
FIG. 1 is a schematic diagram of an electric switch according to an embodiment of the present disclosure.

In the drawings: 100, casing; 101, first groove; 1011, sliding hole; 1012, hanger; 1013, support surface; 1014, resin; 200, actuator; 201, drive portion; 202, abutting portion; 203, reset element; 204, third mounting slot; 205, second groove; 300, movable contact frame; 301, accommodating space; 3011, first abutment surface; 3012, second abutment surface; 3013, third abutment surface; 3014, fourth abutment surface; 3015, strip-shaped hole; 302, retaining portion; 304, first mounting slot; 305, second mounting slot; 306, contact spring; 400, snap-action resilient member; 401, first spring; 402, second spring; 500, first lock member; 600, second lock member; 700, signal switch; 701, brush; 702, circuit board; 7021, limit hole; 703, first terminal; 7031, first counterbore; 704, first resilient element; 705, brush holder; 7051, protrusion; 800, contact switch; 801, movable contact; 802, fixed contact; 803, second terminal; 8031, second counterbore; 900, button; 1000, mounting cavity; 1100, lock mechanism; 561, mounting groove; 562, second resilient element; s1, first slope; s2, second slope; a, lock portion; b, unlock portion; c, reset portion.

DETAILED DESCRIPTION OF EMBODIMENTS

The embodiments of the present disclosure are described in detail below. Examples of the embodiments are shown in the accompanying drawings, in which the same or similar reference numerals indicate the same or similar elements or elements with the same or similar functions. The embodiments described are exemplary, and are intended to explain the present disclosure, but should not be construed as limiting the scope of the present disclosure.

In order to better understand the above technical solutions, the exemplary embodiments of the present disclosure will be further described in detail below with reference to the accompanying drawings. Although the drawings show exemplary embodiments of the present disclosure, it should be understood that the present disclosure can be implemented in various forms and should not be limited by the embodiments set forth herein. On the contrary, these embodiments are intended to let the ordinary skill in the prior art more thoroughly understand the present disclosure.

It should be noted that in the present disclosure, X direction is defined as the positive direction of the first direction; Y direction is defined as the negative direction of the first direction; M direction is defined as the positive direction of the second direction; and N direction is defined as the negative direction of the second direction.

Embodiment 1

Referring to FIGS. 1-27, this embodiment provides an electric switch, including a casing 100 and a mounting cavity 1000 provided in the casing 100. The mounting cavity 1000 is provided with an actuator 200, a movable contact frame 300, a snap-action resilient member 400, a lock mechanism 1100, a contact switch 800 and a signal switch 700. The lock mechanism 1100 includes a first lock member 500 and a second lock member 600.

Specifically, referring to FIGS. 2, 4, 6, 8, 10 and 11, the actuator 200 is capable of reciprocating in the mounting cavity 1000 along a first direction. The actuator 200 is provided with a drive portion 201 and an abutting portion 202 connected to the drive portion 201, and the abutting portion 202 moves together with the drive portion 201. The movable contact frame 300 is provided with an accommodating space 301 and a retaining portion 302. The snap-action resilient member 400 is arranged in the accommodating space 301, and the drive portion 201 is inserted in the accommodating space 301 and moves together with the actuator 200. The drive portion 201 on the actuator 200 is capable of compressing the snap-action resilient member 400 to allow the snap-action resilient member 400 to store energy, that is, when the actuator 200 is driven to reciprocate in the first direction, the drive portion 201 on the actuator 200 moves in the accommodating space 301 and is allowed to contact the snap-action resilient member 400 to compress the snap-action resilient member 400 for energy storage.

Referring to FIGS. 2, 7, 10 and 11, the first lock member 500 and the second lock member 600 are arranged opposite to each other in the mounting cavity 1000, and a gap is arranged between the first lock member 500 and the second lock member 600. Each of the first lock member 500 and the second lock member 600 defines a lock portion a, an unlock portion b, and a reset portion c. One end of the reset portion c abuts in the mounting cavity 1000, and the reset portion c is compressed after subjected to a compression force from the abutting portion 202 of the actuator 200 in a positive direction of a second direction. After the compression force is removed, there is a resetting force to allow the reset portion c to move in a negative direction of the second direction. The resetting force and the compression force have opposite directions. The resetting force enables the lock portion a to move in the negative direction of the second direction to let the retaining portion 302 be locked to limit the movement of the movable contact frame 300. The unlock portion b is pressed by the abutting portion 202 of the actuator 200 to overcome the resetting force of the reset portion c to enable the lock portion a to depart from the retaining portion 302. When one lock portion a locks the retaining portion 302, the other lock portion a is disengaged from the retaining portion 302. It should be understood that when the first lock member 500 locks the movable contact frame 300, the resetting force of the reset portion c of the first lock member 500 enables the lock portion a of the first lock member 500 to lock the retaining portion 302. At this time, the lock portion a of the second lock member 600 departs from the retaining portion 302. When the second lock member 600 locks the movable contact frame 300, the resetting force of the reset portion c of the second lock member 600 enables the lock portion a of the second lock member 600 to lock the retaining portion 302. At this time, the lock portion a of the first lock member 500 departs from the retaining portion 302.

Referring to FIGS. 2 and 9-11, the signal switch 700 includes a brush 701 and a circuit board 702. The circuit board 702 is arranged in the mounting cavity 1000, and the brush 701 is arranged on the movable contact frame 300. The contact switch 800 includes a movable contact 801 and a fixed contact 802. The fixed contact 802 is arranged in the mounting cavity 1000, and the movable contact 801 is arranged on the movable contact frame 300.

Specifically, when the actuator 200 is driven to move in the first direction, the drive portion 201 moves in the first direction to compress the snap-action resilient member 400 for energy storage. The abutting portion 202 moves from one unlock portion b to the other unlock portion b and presses the other unlock portion b to enable the lock portion a corresponding to the other unlock portion b to depart from the retaining portion 302. The snap-action resilient member 400 produces a snap action to release energy to drive the movable contact frame 300 to move in the first direction, so that the brush 701 is driven to slide on the circuit board 702 to switch the signal switch 700 on/off, and the movable contact 801 is driven to move toward or away from the fixed contact 802 to make the movable contact 801 be in contact with or separated from the fixed contact 802, so as to allow the contact switch 800 to be switched on/off. In other words, the drive portion 201 and the abutting portion 202 of the actuator 200 move in the first direction when the actuator 200 moves in the first direction. The drive portion 201 first compresses the snap-action resilient member 400 to store energy, and at this time, one lock portion a locks the retaining portion 302. The actuator 200 continues to move in the first direction, and the abutting portion 202 presses the unlock portion b corresponding to the other lock portion a, so that the other lock portion a is separated from the retaining portion 302. At this time, the movable contact frame 300 is released from the restriction, so that the snap-action resilient member 400 will suddenly produces a snap action to release energy and drive the movable contact frame 300 to move in the first direction, and the signal switch 700 and the contact switch 800 arranged in the movable contact frame 300 and the mounting cavity 1000 will be immediately switched on/off.

Figure 10:
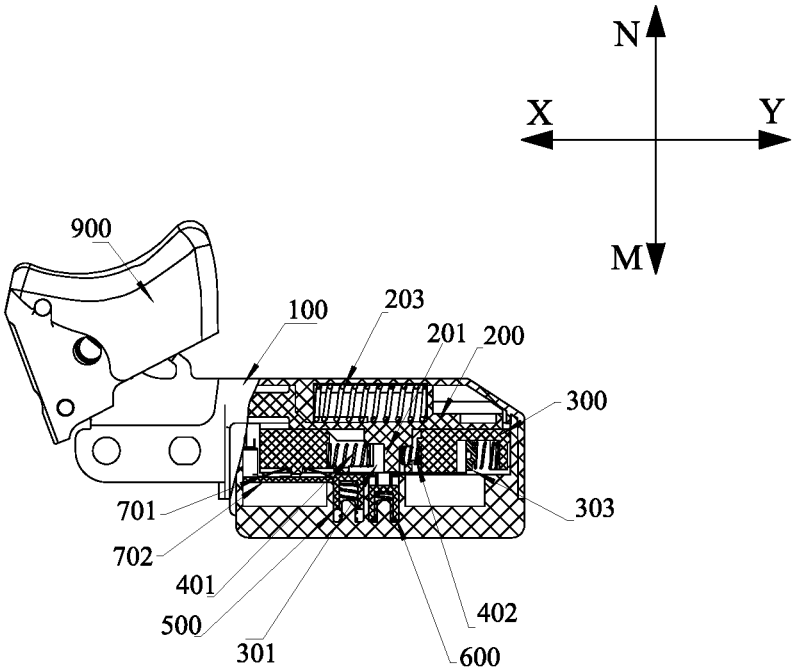
FIG. 10 is a schematic diagram of the electric switch in an initial state according to an embodiment of the present disclosure.
Figure 11:
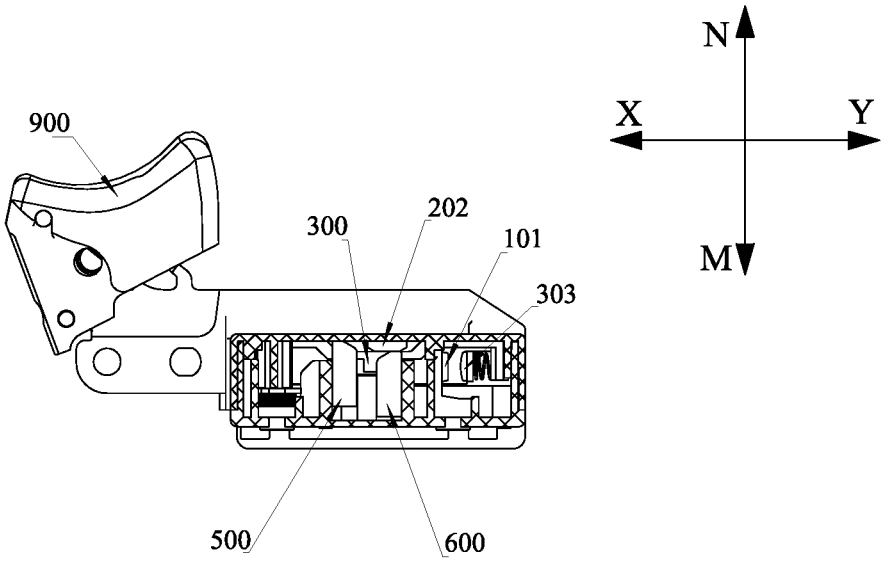
FIG. 11 is another schematic diagram of the electric switch in an initial state according to an embodiment of the present disclosure.
Figure 12:
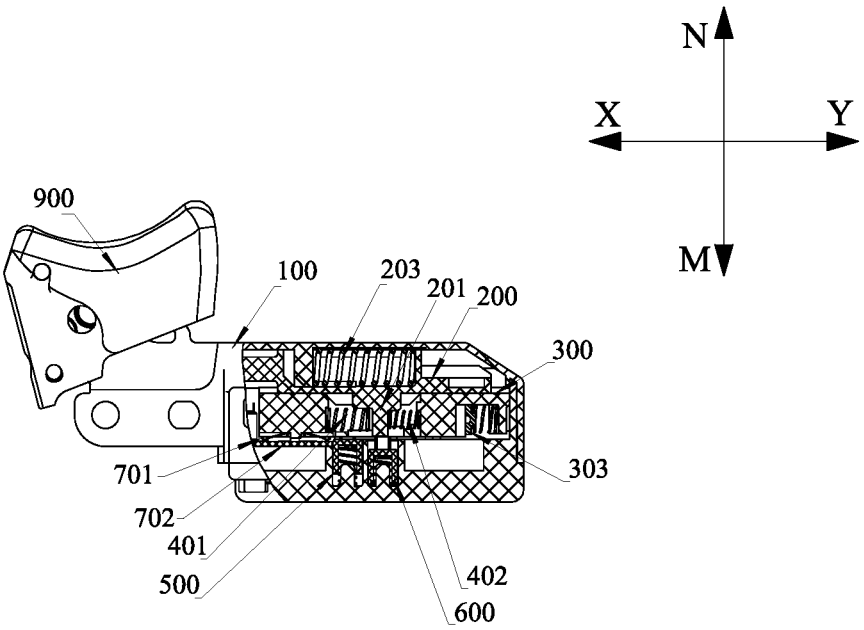
FIG. 12 is a schematic diagram of the electric switch in a first motion state according to an embodiment of the present disclosure.
Figure 13:
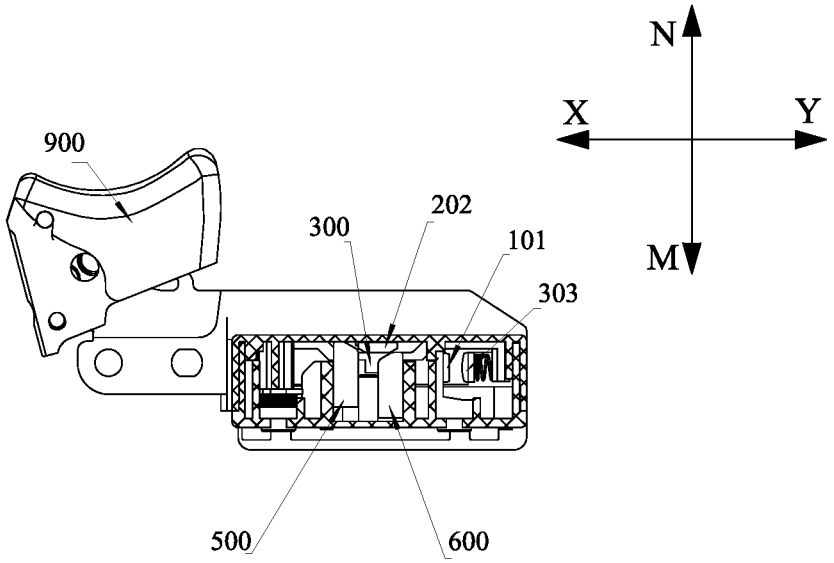
FIG. 13 is another schematic diagram of the electric switch in the first motion state according to an embodiment of the present disclosure.
Figure 14:
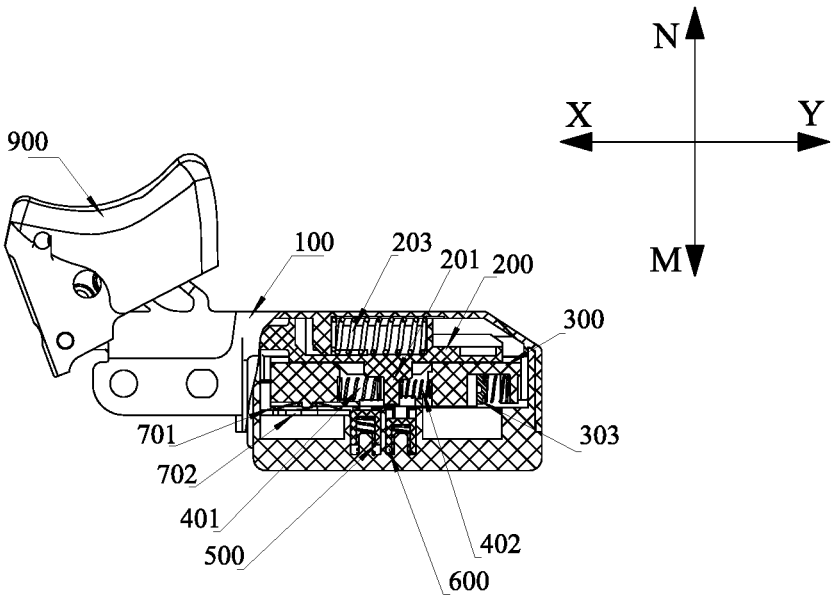
FIG. 14 is a schematic diagram of the electric switch in a second motion state according to an embodiment of the present disclosure.
Figure 15:
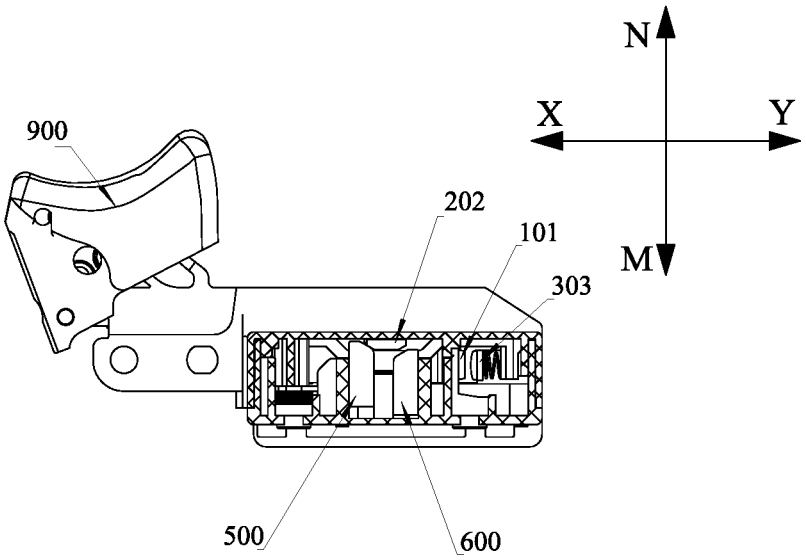
FIG. 15 is another schematic diagram of the electric switch in the second motion state according to an embodiment of the present disclosure.

Referring to FIGS. 10-11, when the electric switch is in an initial state, the snap-action resilient member 400, the first lock member 500, and the second lock member 600 do not play a locking role, and the actuator 200 drives the movable contact frame 300 to move in the positive direction of the first direction to allow the movable contact frame 300 to contact the first lock member 500. At this time, the first lock member 500 locks the movable contact frame 300. When the actuator 200 continues to move in the positive direction of the first direction, the abutting portion 202 presses the unlock portion b of the first lock member 500 to unlock the movable contact frame 300 until a critical position of unlocking is reached. At the same time, the snap-action resilient member mounted in the movable contact frame is subject to the compression force exerted in the positive direction of the first direction by the drive portion 201 of the actuator 200 and is compressed to store energy. After the movable contact frame 300 is unlocked, the snap-action resilient member 400 is released instantaneously, and the movable contact frame 300 moves quickly to enable the signal switch 700 and the contact switch 800 to be switched on instantaneously. At this time, the second lock member 600 locks the movable contact frame 300, which ensures that the contact switch 700 is reliably switched on, and eliminates the contact bounce and the poor contact caused by improper operation, effectively preventing the contacts from being burned and prolonging the service life of the electric switch. When the actuator 200 is driven to move in the negative direction of the first direction to reset, the snap-action resilient member 400 produces a reverse snap action to enable the electric switch to be switched off or on instantaneously. The snap-action force generated by the snap-action resilient member 400 is a pure horizontal force, which is different from the diagonal snap-action force generated by the conventional electric switches which shortens the service life of the electric switch. Therefore, the horizontal force enables the electric switch of the present disclosure to have a prolonged service life and thus satisfy market demands. The signal switch 700 may be arranged at a front end or a rear end of a bottom of the mounting cavity 1000, so as to properly utilize the space.

Figure 6:
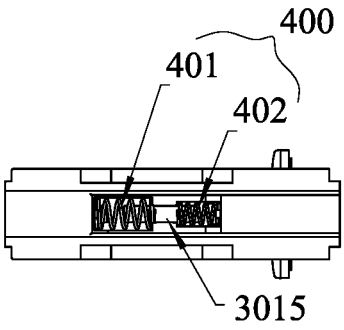
FIG. 6 is a schematic diagram of the movable contact frame from another perspective according to an embodiment of the present disclosure, in which the brush and the snap-action resilient member are mounted.

In some embodiments, referring to FIGS. 6 and 10, the snap-action resilient member 400 includes a first spring 401 and a second spring 402 arranged on two sides of the drive portion 201. The first spring 401 may be compressed by one side of the drive portion 201 to store energy, and the second spring 402 may be compressed by the other side of the drive portion 201 to store energy. In other words, when the drive portion 201 moves in the positive direction of the first direction, the first spring 401 can be compressed by the drive portion 201 to store energy; and when the drive portion 201 moves in the negative direction of the first direction, the second spring 402 is compressed by the drive portion to store energy. It should be noted that in other examples, the snap-action resilient member 400 may also adopt a single spring structure. For example, only the first spring is provided and the second spring is removed. In some embodiment, referring to FIGS. 4, 6 and 10, the accommodating space 301 has a first abutment surface 3011 and a second abutment surface 3012 opposite to each other, and a third abutment surface 3013 and a fourth abutment surface 3014 opposite to each other. One end of the first spring 401 abuts the first abutment surface 3011, and the other end of the first spring 401 abuts the second abutment surface 3012 and may contact the drive portion 201. One end of the second spring 402 abuts the third abutment surface 3013, and the other end of the second spring 402 abuts the fourth abutment surface 3014 and may contact the drive portion 201. It should be understood that when the first spring 401 is in a free state, one end of the first spring 401 abuts the first abutment surface 3011, and the other end of the first spring 401 abuts the second abutment surface 3012. When the drive portion 201 moves in the positive direction of the first direction, the drive portion 201 contacts the end of the first spring 401 that abuts on the second abutment surface 3012, and the first spring 401 is compressed. Similarly, when the second spring 402 is in a free state, one end of the second spring 402 abuts the third abutment surface 3013, and the other end of the second spring 402 abuts the fourth abutment surface 3014. When the drive portion 201 moves in the positive direction of the first direction, the drive portion 201 contacts the end of the second spring 402 that abuts on the fourth abutment surface 3014, and the second spring 402 is compressed.

Figure 4:
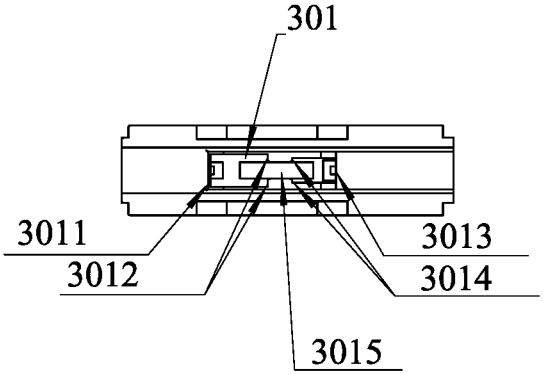
FIG. 4 is a schematic diagram of a movable contact frame according to an embodiment of the present disclosure.

Specifically, referring to FIGS. 4 and 6, a strip-shaped hole 3015 may be provided in the accommodating space 301 for the movement of the drive portion 201. One end of the strip-shaped hole 3015 is located between the first abutment surface 3011 and the second abutment surface 3012, and the other end of the strip-shaped hole 3015 is located between the third abutment surface 3013 and the fourth abutment surface 3014.

Figure 5:
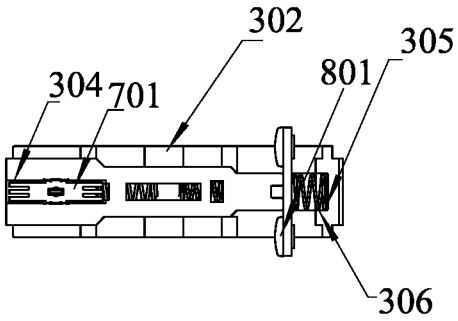
FIG. 5 is a schematic diagram of the movable contact frame according to an embodiment of the present disclosure, in which a brush and a snap-action resilient member are mounted.

In some embodiments, referring to FIG. 5, the retaining portion 302 is a convex block extending downward from a bottom surface of the movable contact frame 300. In some embodiments, there are two retaining portions 302 which are oppositely arranged on two sides of the strip-shaped hole 3015.

Figure 7:
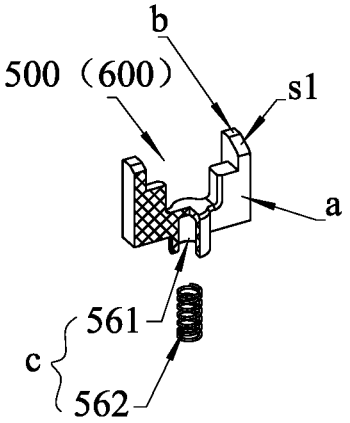
FIG. 7 is a schematic diagram of a lock member according to an embodiment of the present disclosure.

Referring to FIG. 7, the lock portion a is a column. When a side surface of the lock portion 302 contacts a side surface of the lock portion a, the lock portion a abuts against the retaining portion 302 to lock the retaining portion 302. When a bottom surface of the retaining portion 302 crosses the top surface of the lock portion a, the retaining portion 302 is separated from the side surface of the lock portion a.

Figure 8:
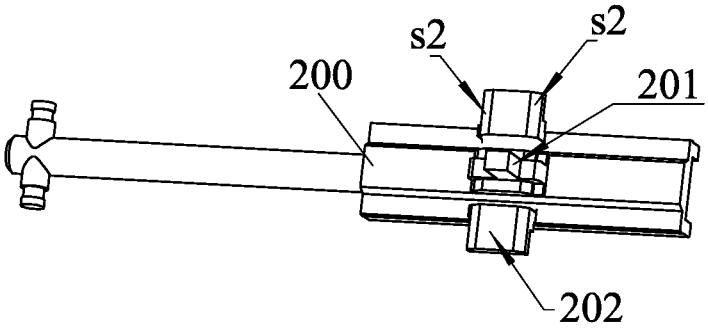
FIG. 8 is a schematic diagram of an actuator according to an embodiment of the present disclosure.

In some embodiments, referring to FIGS. 7 and 8, the unlock portion b is a block arranged on a side of the lock portion a. A top of the unlock portion b has a first slope s1, and the abutting portion 202 has a second slope s2. The second slope s2 abuts against the first slope s1 to press the unlock portion b to overcome the resetting force of the reset portion c. In order to ensure the reliable pressing between the unlock portion b and the abutting portion 202, each of the first slope s1 and the second slope s2 transitions to a plane after the first slope s1 and the second slope s2 contact with each other. That is, a plane is provided at the top of the unlock portion behind the first slope s1 for transition, and a plane is provided behind the second slope s2 of the abutting portion 202 for transition. In addition, the first slope s1 of the unlock portion b of the first lock member 500 and the first slope s1 of the unlock portion b of the second lock member 600 are opposite to each other and have opposite inclination directions. The second slope s2 may include a front slope and a rear slope which respectively correspond to the first slope s1 of the unlock portion b of the first lock member 500 and the first slope s1 of the unlock portion b of the second lock member 600. There are two retaining portions 302, and each of the first lock member 500 and the second lock member 600 is provided with two lock portions a and two unlock portions b on both sides of the reset portion c. The actuator 200 is provided with two abutting portions 202. The retaining portions 302 correspond to the lock portions a on the first lock member 500 and the lock portions on the second lock member 600, respectively. The lock portions a and the unlock portions b have a one-to-one correspondence. The unlock portions b on the first lock member 500 and the unlock portions b on the second lock member 600 correspond to the abutting portions 202, respectively.

The reset portion c has a mounting groove 561 and a second resilient element 562. One end of the second resilient element 562 abuts in the mounting groove 561, and the other end of the second resilient element 562 abuts in the mounting cavity 1000. In other words, the second resilient element 562 is partially inserted into the mounting groove 561, and the second resilient element 562 can be compressed after being pressed by the abutting portion 202 of the actuator 200 in the positive direction of the second direction, and the end of the second resilient element 562 away from the mounting groove 561 abuts in the mounting cavity 1000. After the pressing force is removed, the elastic force caused by the compression of the second resilient element 562 allows the reset portion c to have a resetting force in a negative direction of the second direction, and the direction of the resetting force is opposite to the direction of the pressing force. When the abutting portion 202 presses the unlock portion b, the second resilient element 562 is compressed by the pressing force of the abutting portion 202 in the positive direction of the second direction, so that the lock portion a moves downward and separates from the retaining portion 302. The second resilient element 562 may be a compression spring. In order to facilitate the mounting of the first lock member 500 and the second lock member 600, a limit post may be provided in the mounting cavity 1000 to mount the second resilient element 562.

Figure 2:
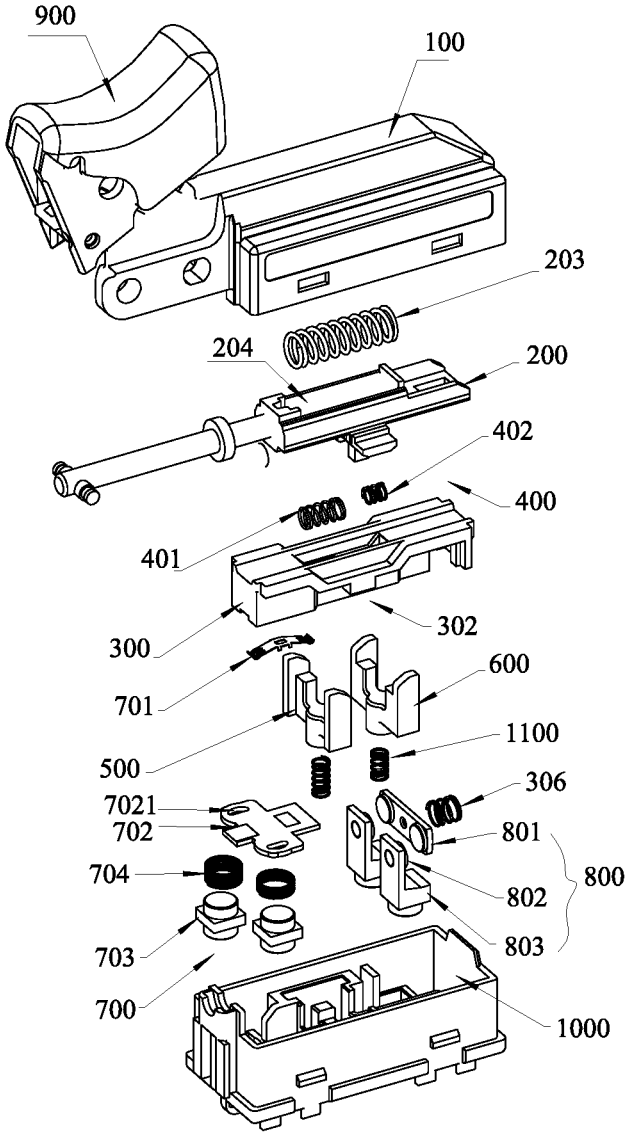
FIG. 2 is an exploded view of the electric switch according to an embodiment of the present disclosure.
Figure 3:
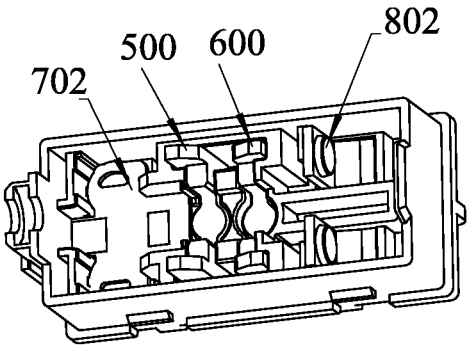
FIG. 3 is a schematic diagram of an internal structure of the electric switch according to an embodiment of the present disclosure.
Figure 9:
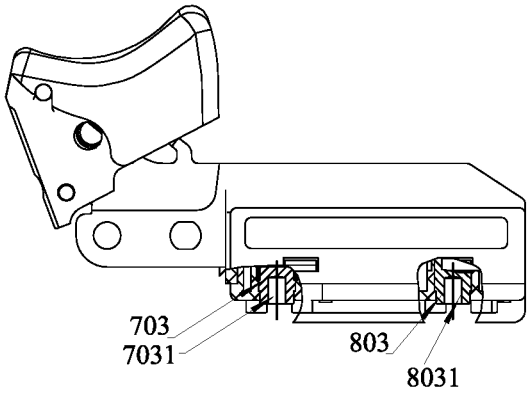
FIG. 9 schematically shows cross sections of parts of the electric switch according to an embodiment of the present disclosure.

In some embodiments, referring to FIGS. 2-3 and 9, in terms of the signal switch 700, the brush 701 is arranged on the movable contact frame 300, and the circuit board 702 is arranged in the mounting cavity 1000. When the movable contact frame 300 moves, the brush 701 slides on the circuit board 702; when the brush 701 is connected to a conductive sheet on the circuit board 702, the signal switch 700 is switched on. When the brush 701 fails to contact the conductive sheet on the circuit board 702, the signal switch 700 is switched off. The brush 701 slides horizontally or rotationally on the circuit board 702.

Specifically, referring to FIGS. 2, 5 and 9, the electric switch further includes a first terminal 703, and the circuit board 702 is mounted in the mounting cavity 1000 through the first terminal 703. A first mounting slot 304 may be provided on the movable contact frame 300, and the brush 701 is mounted in the first mounting slot 304. When the movable contact frame 300 is assembled into the mounting cavity 1000, the brush 701 contacts the circuit board 702 and is located above the circuit board 702.

In some embodiments, referring to FIGS. 2 and 9, the circuit board 702 and the first terminal 703 are electrically connected through the first resilient element 704; or the circuit board 702 and the first terminal 703 are riveted to realize the electrical connection therebetween.

Referring to FIG. 9, in order to prevent foreign matters from entering the electric switch and ensure the protection capability of the electric switch, a first counterbore 7031 is provided on the first terminal 703. In the first counterbore 7031, the first terminal 703 can be connected to an external conductor through a locking screw.

Referring to FIGS. 2 and 3, during the assembling of the circuit board 702, a first fastener on the casing 100 is inserted into a limit hole 7021 on the circuit board 702, and the circuit board 702 is pressed and held through a second fastener on the casing 100, thereby ensuring that the circuit board 702 is reliably fixed in the mounting cavity 1000.

In some embodiments, referring to FIGS. 2, 5 and 9, the movable contact 801 of the contact switch 800 is arranged on the movable contact frame 300, and the fixed contact 802 of the contact switch 800 is arranged in the mounting cavity 1000. When the movable contact frame 300 moves in the first direction, the movable contact 801 contacts the fixed contact 802 to form a conduction circuit; or the movable contact 801 is separated from the fixed contact 802, and the conduction circuit is cut off. That is, the movement of the movable contact frame 300 can drive the movable contact 801 to move close to or away from the fixed contact 802, so that the movable contact 801 and the fixed contact 802 are in contact with or separated from each other, thereby controlling the on/off of the circuit.

Referring to FIGS. 2 and 5, the electric switch further includes a second terminal 803, and the fixed contact 802 can be mounted in the mounting cavity 1000 through a second terminal 803. The movable contact frame 300 may be provided with a second mounting slot 305, and the movable contact 801 is mounted in the second mounting slot 305. When the movable contact frame 300 is assembled into the mounting cavity 1000, the movable contact 801 and the fixed contact 802 are arranged opposite to each other, and there is a gap between the movable contact 801 and the fixed contact 802. Furthermore, the movable contact 801 is connected to one end of a contact spring 306, and the end of the contact spring 306 away from the movable contact 801 is mounted in the second mounting slot 305.

Referring to FIGS. 2 and 9, in order to prevent foreign matters from entering the electric switch and ensure the protection capability of the electric switch, a second counterbore 8031 is provided on the second terminal 803. In the second counterbore 8031, the second terminal 803 can be connected to an external conductor through a locking screw.

Referring to FIGS. 2 and 5, the signal switch 700 may be arranged on a left side of the first lock member 500, or on a right side of the second lock member 600. Correspondingly, the contact switch 800 may be arranged on the right side of the second lock member 600, or on the left side of the first lock member 500.

In some embodiments, referring to FIGS. 2 and 10, the actuator 200 and the mounting cavity 1000 are connected by a reset element 203, and one end of the actuator 200 penetrates the mounting cavity 1000 and is hinged with a button 900. It should be understood that the reciprocating movement of the actuator 200 in the first direction in the mounting cavity 1000 is driven by artificially pressing the button 900 and the resetting force of the reset element 203. Specifically, the actuator 200 is provided with a third mounting slot 204, and the mounting cavity 1000 is provided with an extension block extending to the third mounting slot 204. One end of the reset element 203 abuts against the third mounting slot 204, and the other end of the reset element 203 abuts against the extension block. The reset element 203 may be a spring.

Referring to FIGS. 2, 4 and 8, the drive portion 201 of the actuator 200 is a protruding rod, and the drive portion 201 is formed by extending downward from the bottom surface of the actuator 200. The abutting portion 202 is formed by extending outward from the side surface of the actuator 200. When the actuator 200 is assembled into the mounting cavity 1000, the drive portion 201 is inserted in the strip-shaped hole 3015 and is movable in the strip-shaped hole 3015.

The snap and locking actions of the electric switch will be described below with reference to FIGS. 10-27.

Referring to FIGS. 4, 10 and 11, the electric switch is in the initial state, and the first lock member 500 does not play a locking role. The unlock portions b of the first lock member 500 abuts on a top of the mounting cavity 1000, and the unlock portions b of the second lock member 600 abuts on the plane of the abutting portion 202 of the actuator 200. The first spring 401 is located in the movable contact frame 300, and both ends of the first spring 401 abut on the first abutment surface 3011 and the second abutment surface 3012, respectively. One end of the second spring 402 abuts on the third abutment surface 3013 of the movable contact frame 300, and the other end of the second spring 402 abuts on the drive portion 201 of the actuator 200.

Referring to FIGS. 2, 4, 12 and 13, the button 900 is pressed, and the actuator 200 is driven to move in the positive direction of the first direction. The drive portion 201 of the actuator 200 is located on the second abutment surface 3012 and the fourth abutment surface 3014 of the movable contact frame 300, and the first spring 401 and the second spring 402 are located in the movable contact frame 300. At this time, the drive portion 201 of the actuator 200 does not compress the first spring 401 and the second spring 402 for energy storage. The unlock portion b of the first lock member 500 still abuts on the top of the mounting cavity 1000, and the abutting portion 202 of the actuator 200 starts to move away from the second lock member 600 and approach the first lock member 500. The movable contact frame 300 is still in the initial state and has not moved.

Referring to FIGS. 2, 4, 14 and 15, when the button 900 is continuously pressed, the actuator 200 is driven to move in the positive direction of the first direction. The drive portion 201 of the actuator 200 contacts and interacts with the first spring 401 in the movable contact frame 300, and the movable contact frame 300 is driven to move in the positive direction of the first direction. When the movable contact frame 300 moves for a certain displacement, the retaining portion 302 of the movable contact frame 300 abuts on the lock portion a of the first lock member 500. At this time, the first lock member 500 locks the movable contact frame 300, and the movable contact frame 300 is not able to move. The drive portion 201 of the actuator 200 is located between the second abutment surface 3012 and the fourth abutment surface 3014 of the movable contact frame 300. The first spring 401 and the second spring 402 are located in the movable contact frame 300. The drive portion 201 of the actuator 200 does not exert a compression force on the first spring 401 and the second spring 402 for energy storage.

Figure 16:
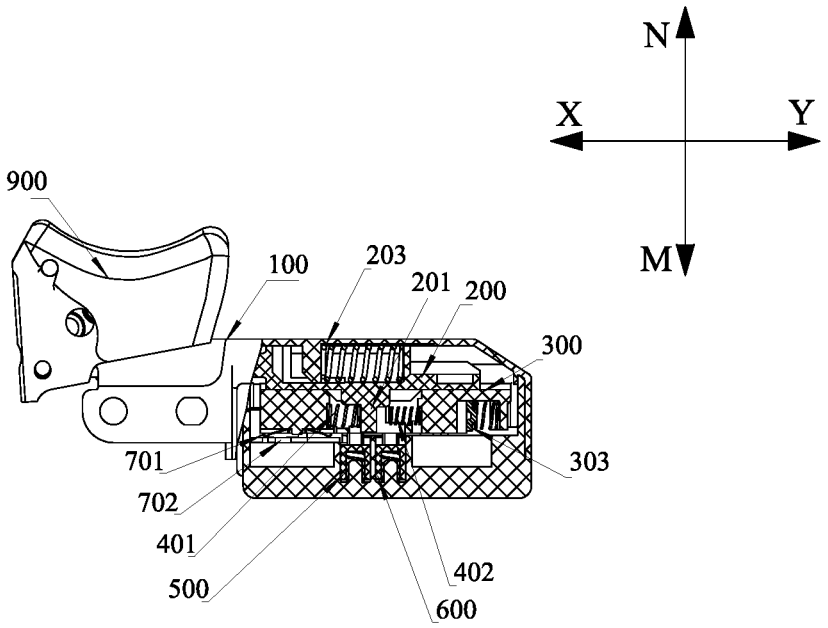
FIG. 16 is a schematic diagram of the electric switch in a third motion state according to an embodiment of the present disclosure.
Figure 17:
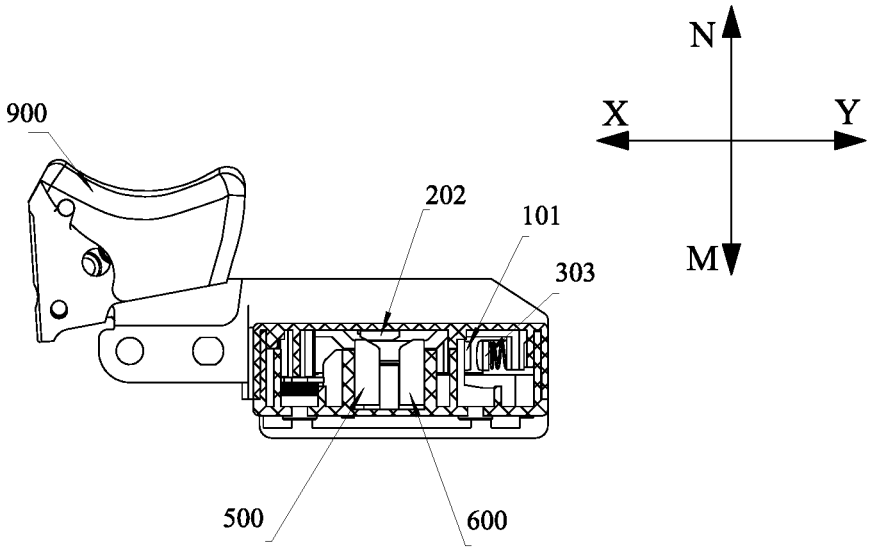
FIG. 17 is another schematic diagram of the electric switch in the third motion state according to an embodiment of the present disclosure.

Referring to FIGS. 2, 16 and 17, the button 900 is continuously pressed, and the actuator 200 is driven to move in the positive direction of the first direction. Since the movable contact frame 300 is locked by the first lock member 500, the movable contact frame 300 is not capable of moving, and the first spring 401 in the movable contact frame 300 is continuously compressed by the drive portion 201 for energy storage. The unlock portion b of the first lock member 500 is pressed by the front slope of the abutting portion 202 of the actuator 200 and moves in the positive direction of the second direction until the critical state of unlocking is reached.

Figure 18:
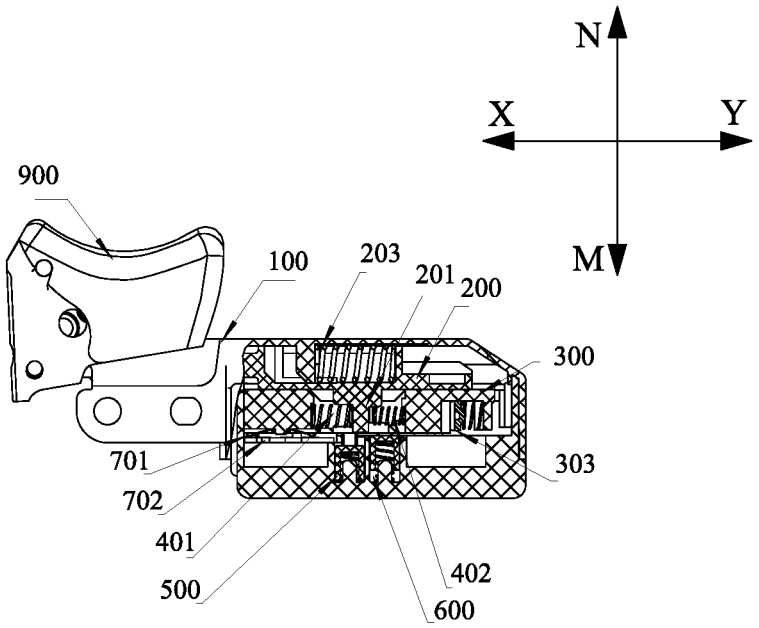
FIG. 18 is a schematic diagram of the electric switch in a fourth motion state according to an embodiment of the present disclosure.
Figure 19:
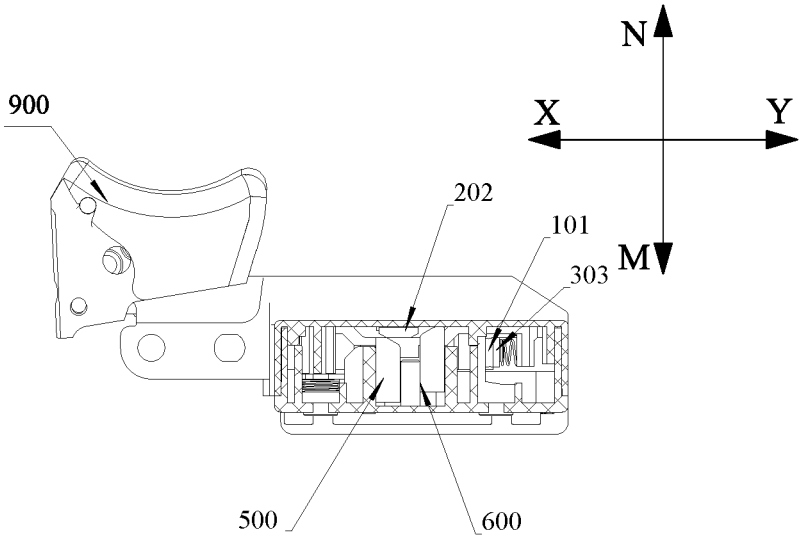
FIG. 19 is another schematic diagram of the electric switch in the fourth motion state according to an embodiment of the present disclosure.

Referring to FIGS. 2, 18 and 19, when the button 900 is continuously pressed, the actuator 200 continues to move in the positive direction of the first direction. The unlock portion b of the first lock member 500 is pressed by the abutting portion 202 of the actuator 200, and the first lock member 500 moves in the positive direction of the second direction. The movable contact frame 300 is unlocked, and the first spring 401 immediately jumps to release energy, and the movable contact frame 300 quickly moves in the positive direction of the first direction. Finally, the movable contact 801 contacts the fixed contact 802, causing the contact switch 800 to be switched on instantaneously; and the brush 701 slides on the circuit board 702 and contacts the conductive sheet on the circuit board 702, so that the signal switch 700 is switched on. When the movable contact frame 300 rapidly moves in the positive direction of the first direction, the second lock member 600 moves in the negative direction of the second direction under the action of the reset portion c to lock the movable contact frame 300. This ensures the reliable connection between the movable contact 801 and the fixed contact 802 and the reliable connection between the brush 701 and the conductive sheet on the circuit board 702, avoiding the burning of the contacts caused by the bounce, the shaking or the undesirable phenomenon of non-communication of contacts, thus prolonging the service life of the electric switch.

Figure 20:
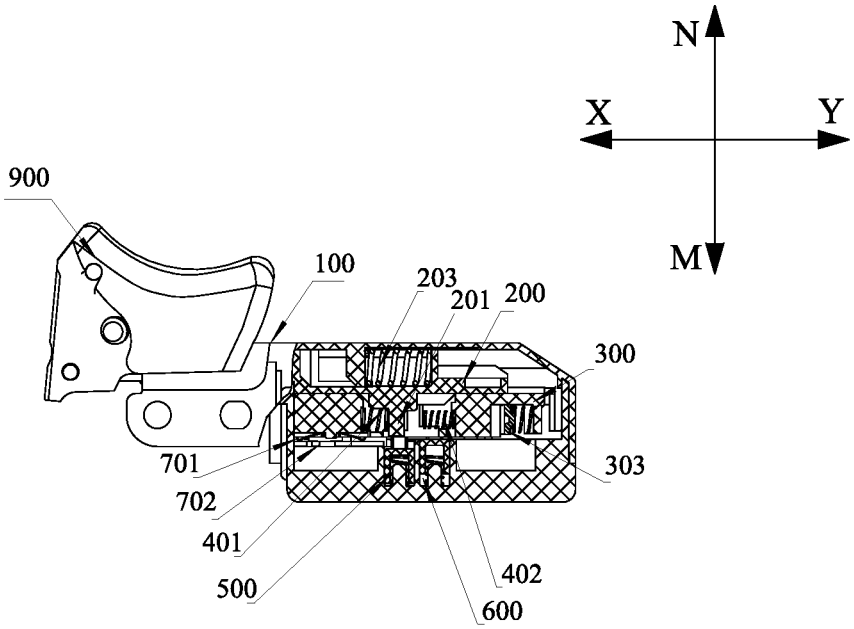
FIG. 20 is a schematic diagram of the electric switch in a fifth motion state according to an embodiment of the present disclosure.
Figure 21:
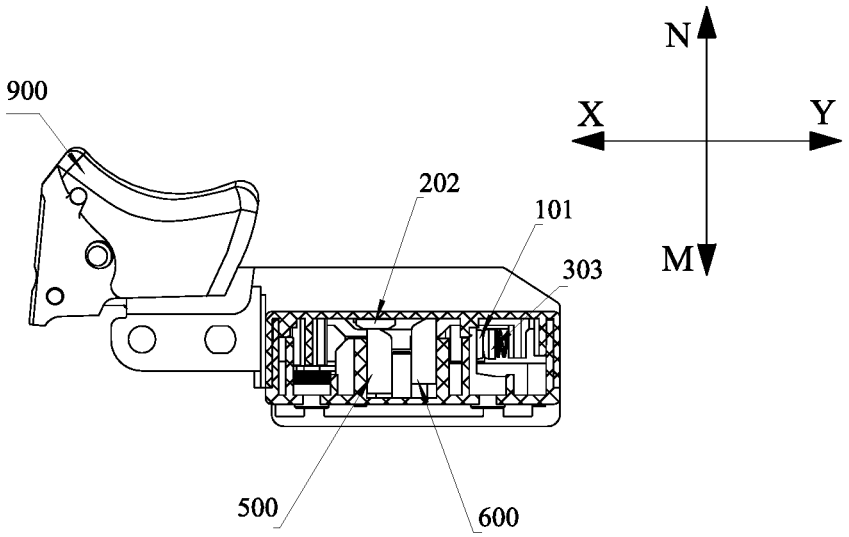
FIG. 21 is another schematic diagram of the electric switch in the fifth motion state according to an embodiment of the present disclosure.
Figure 22:
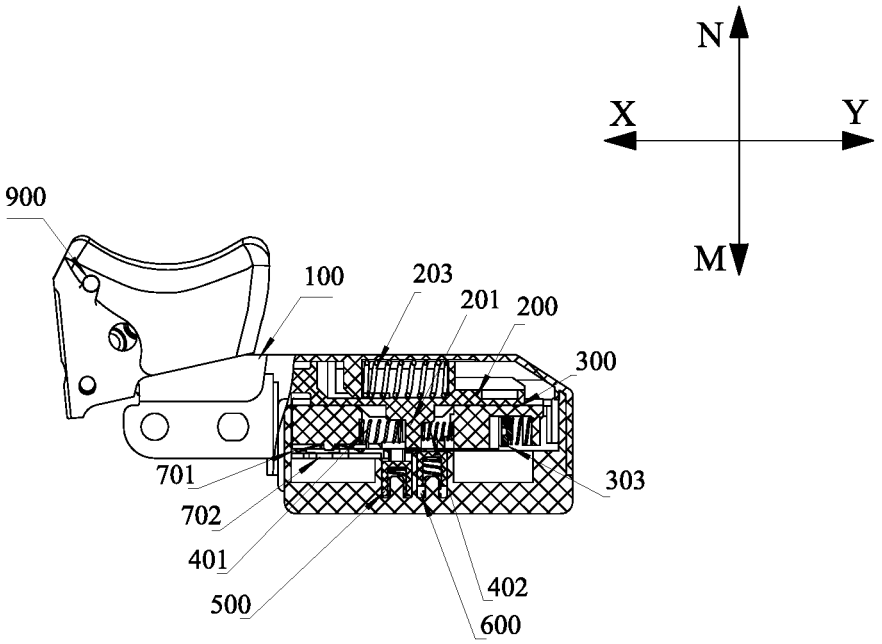
FIG. 22 is a schematic diagram of the electric switch in a sixth motion state according to an embodiment of the present disclosure.
Figure 23:
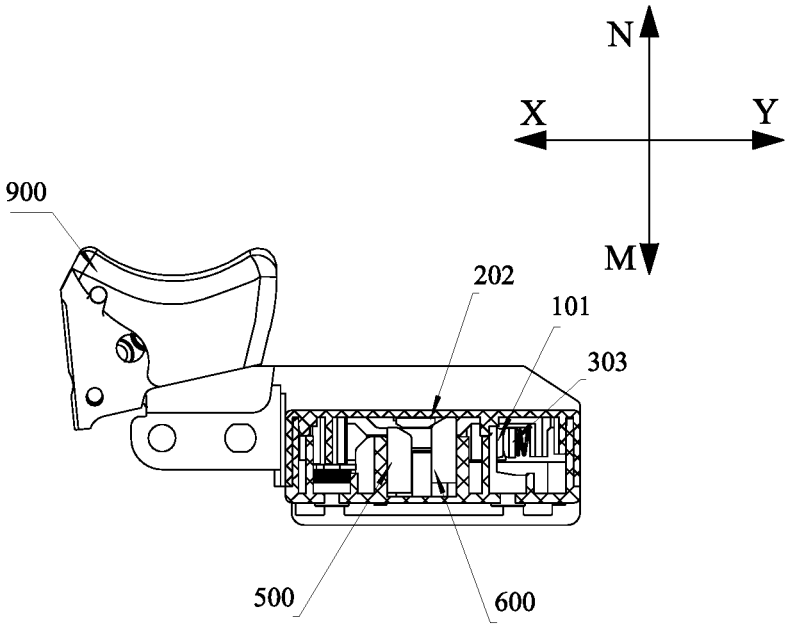
FIG. 23 is another schematic diagram of the electric switch in the sixth motion state according to an embodiment of the present disclosure.

Referring to FIGS. 2, 20 and 21, when the button 900 is continuously pressed, the actuator 200 continues to move in the positive direction of the first direction, and the first spring 401 is compressed by the drive portion 201 of the actuator 200 to store energy. At this time, the first lock member 500 is in an unlocked state, and the second lock member 600 still locks the movable contact frame 300, and the contact switch 800 and the signal switch 700 are still in an on state.

Referring to FIGS. 2, 4, 7, 22 and 23, the button 900 is released, and the actuator 200 moves in the negative direction of the first direction under the action of the elastic force of the reset element 203 and the first spring 401. The drive portion 201 is located between the second abutment surface 3012 and the fourth abutment surface 3014 of the movable contact frame 300, and the second spring 402 is not compressed for the energy storage by the drive portion 201. The rear slope of the abutting portion 202 abuts on the first slope s1 of the second lock member 600, and the second lock member 600 still locks the movable contact frame 300. The contact switch 800 and the signal switch 700 are still in the on state.

Figure 24:
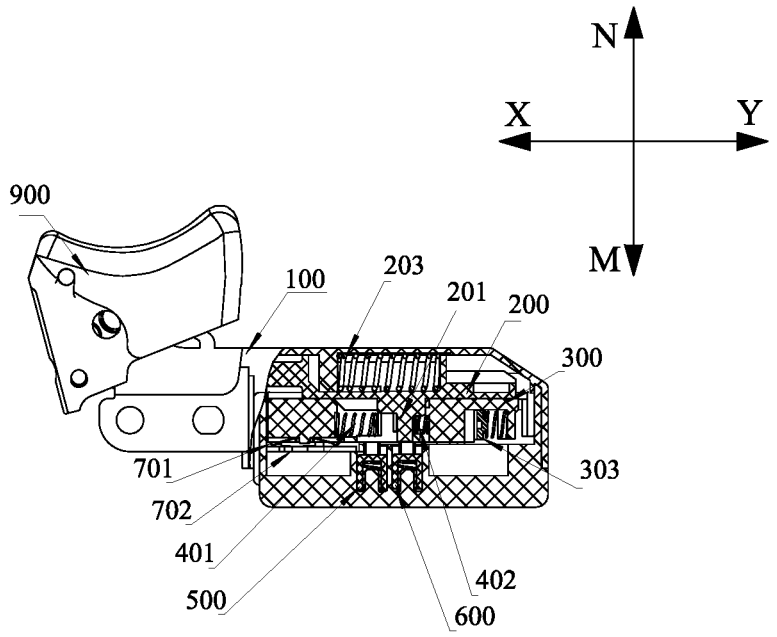
FIG. 24 is a schematic diagram of the electric switch in a seventh motion state according to an embodiment of the present disclosure.
Figure 25:
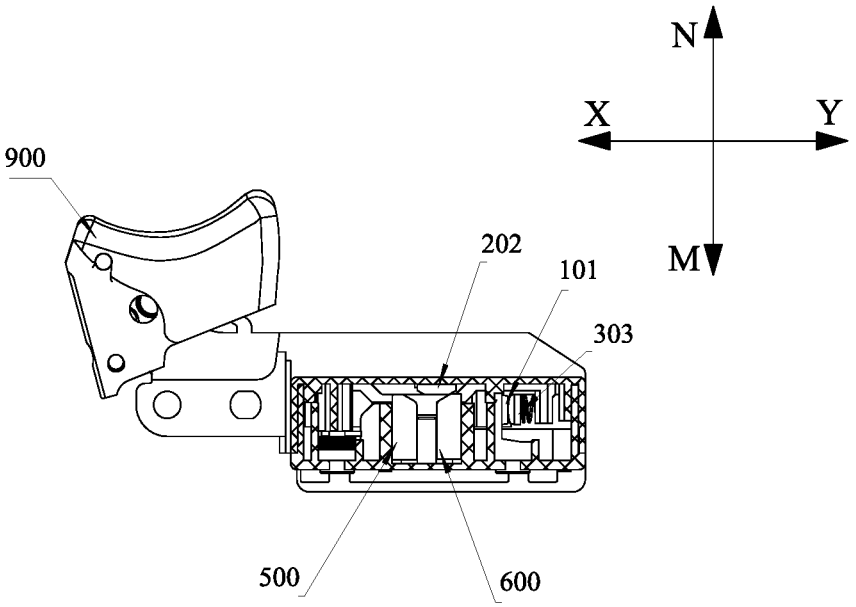
FIG. 25 is another schematic diagram of the electric switch in the seventh motion state according to an embodiment of the present disclosure.

Referring to FIGS. 2, 24 and 25, the button 900 is released, and the actuator 200 continues to move in the negative direction of the first direction. Since the second lock member 600 locks the movable contact frame 300, the drive part 201 compresses the second spring 402 for energy storage. The unlock portion b of the second lock member 600 is pressed by the rear slope of the abutting portion 202 of the actuator 200 and moves in the positive direction of the second direction until the critical state of unlocking is reached.

Figure 26:
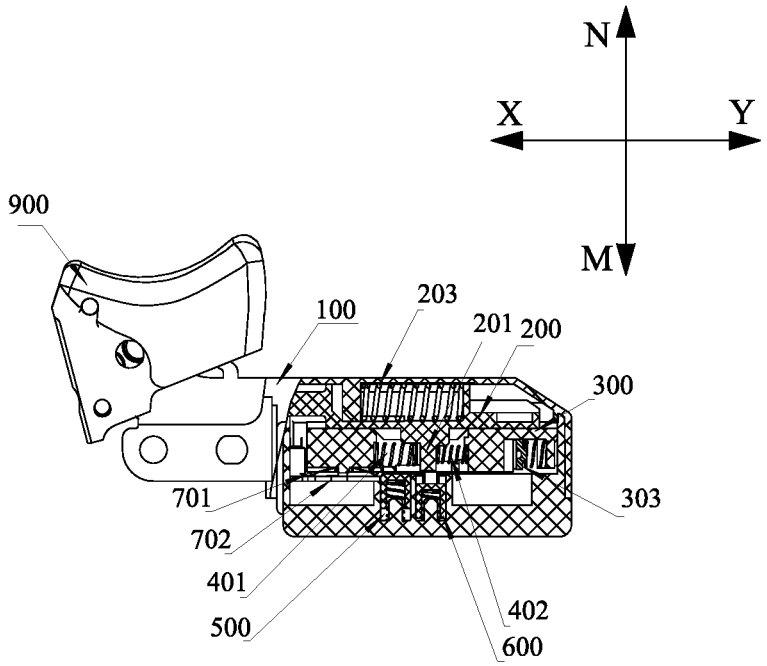
FIG. 26 is a schematic diagram of the electric switch in an eighth motion state according to an embodiment of the present disclosure.
Figure 27:
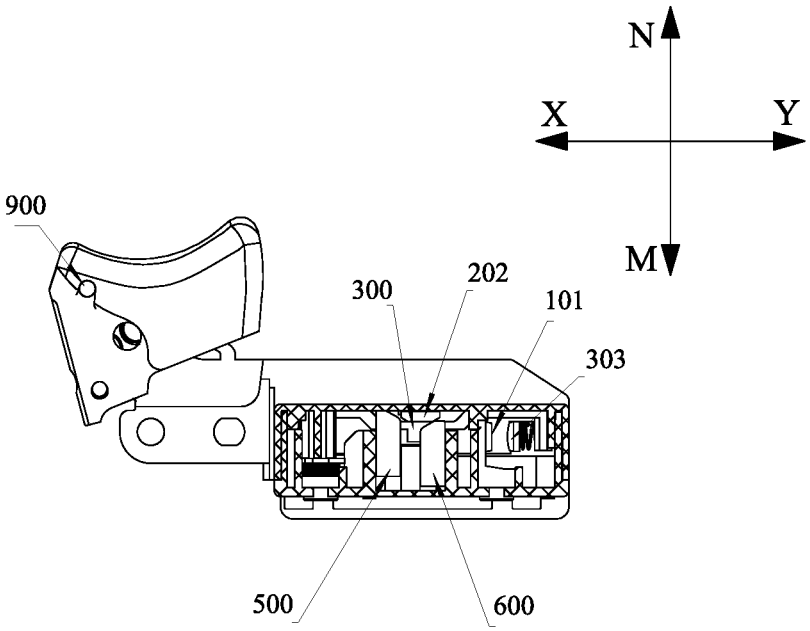
FIG. 27 is another schematic diagram of the electric switch in the eighth motion state according to an embodiment of the present disclosure.
Figure 28:
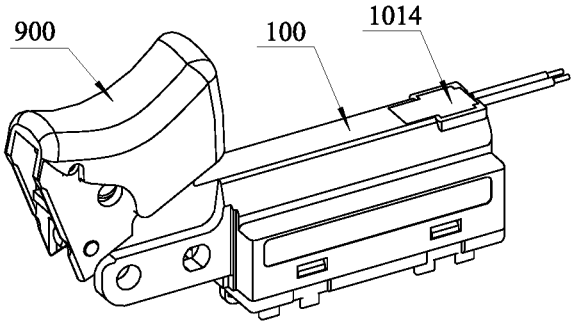
FIG. 28 is a schematic diagram of an electric switch according to another embodiment of the present disclosure.

Referring to FIGS. 2, 26 and 27, the button 900 is released, and the actuator 200 continues to move in the negative direction of the first direction. The unlock portion b of the second lock member 600 is pressed by the abutting portion 202 of the actuator 200, and the second lock member 600 moves in the positive direction of the second direction to unlock the movable contact frame 300. The second spring 402 suddenly releases energy to drive the movable contact frame 300 to move rapidly in the negative direction of the first direction, so that the contact switch 800 and the signal switch 700 are momentarily disconnected. When the movable contact frame 300 rapidly moves in the negative direction of the first direction, the lock portion a of the first lock member 500 moves in the negative direction of the second direction under the action of the reset portion c, and abuts against the retaining portion 302 of the movable contact frame 300 to lock the movable contact frame 300 until the button returns to the initial position. At this time, the electric switch is in the initial state.

Embodiment 2

Referring to FIGS. 28-49, another electrical switch provided by the present disclosure will be described in detail below. The structure and principle of the electric switch are roughly the same as those in the Embodiment 1, and the same parts will not be described herein.

In this embodiment, referring to FIGS. 28-31, the electric switch includes a casing 100, a mounting cavity 1000 provided in the casing 100. An actuator 200, a movable contact frame 300, a snap-action resilient member 400, a lock mechanism 1100, a contact switch 800, and a signal switch 700 are provided in the mounting cavity 1000. The lock mechanism 1100 includes a first lock member 500 and a second lock member 600.

Referring to FIGS. 28-31, the signal switch 700 includes a brush 701 and a circuit board 702. The circuit board 702 is arranged on the casing 100, and the brush 701 is connected to the actuator 200, so that brush 701 is driven to move through the movement of the actuator 200.

Figure 29:
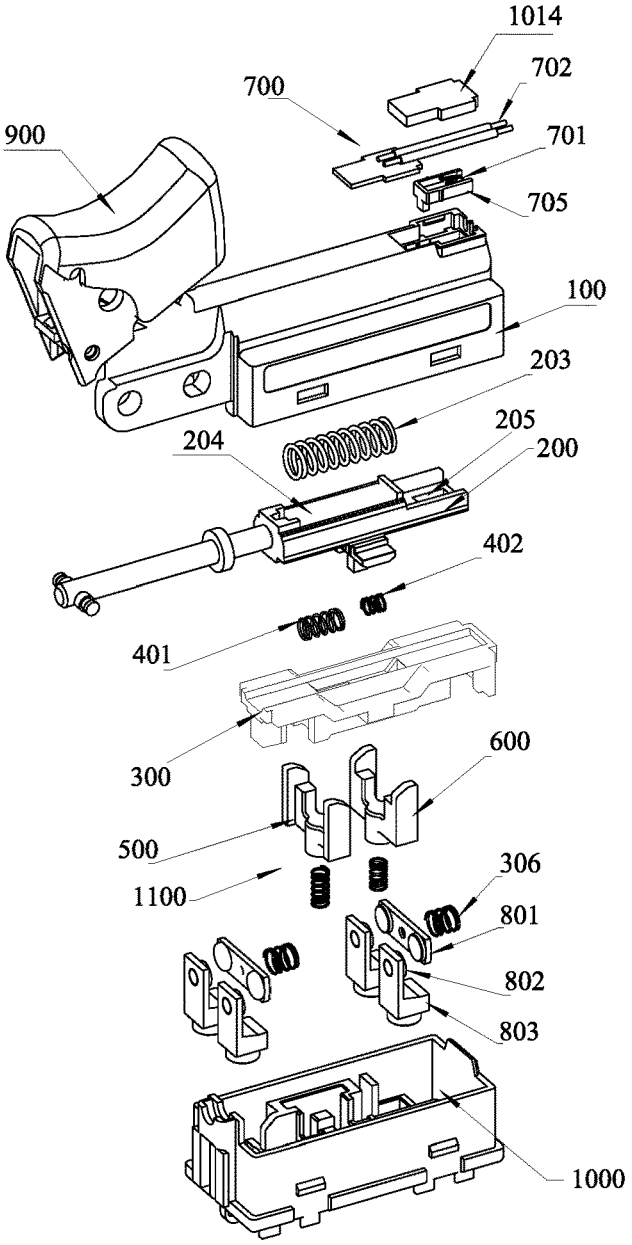
FIG. 29 is an exploded view of the electric switch according to another embodiment of the present disclosure.
Figure 30:
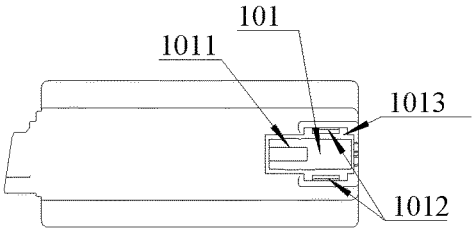
FIG. 30 is a schematic diagram of parts of the electric switch according to another embodiment of the present disclosure.
Figure 31:
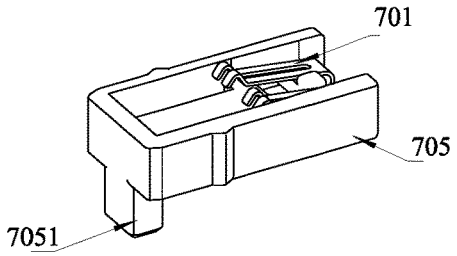
FIG. 31 is another schematic diagram of some parts of the electric switch according to another embodiment of the present disclosure.

Specifically, referring to FIGS. 29-31, a first groove 101 is provided on the casing 100, and a sliding hole 1011 is provided in the first groove 101. A brush holder 705 is also provided in the first groove 101, and the brush 701 is mounted on the brush holder 705. In addition, a protrusion 7051 extends downward from the brush holder 705. The protrusion 7051 is inserted into the sliding hole 1011 and is slidable in the sliding hole 1011. The actuator 200 is provided with a second groove 205. When the actuator 200 is assembled in the mounting cavity 1000, the protrusion 7051 passes through the sliding hole 1011 and is inserted into the second groove 205. In this way, when the actuator 200 moves, the protrusion 7051 can abut against the inner side walls of the second groove 205, and the protrusion 7051 is driven to slide in the sliding hole 1011 with the movement of the actuator 200. As a result, the brush 701 is driven to slide by the brush holder 705.

Furthermore, referring to FIGS. 29-31, a hanger 1012 and a support surface 1013 are respectively provided on an inner side wall of the first groove 101. The support surface 1013 is located below the hanger 1012. The circuit board 702 is attached to the support surface 1013 and hung by the hanger 1012, and then sealed by a resin 1014, so that the circuit board 702 is disposed on the casing 100 and above the brush 701, and the circuit board 702 can contact the brush 701.

The signal switch 700 is arranged on an upper end of a rear of the casing 100, so that the arrangement of the signal switch is diversified, facilitating the proper use of space.

The sudden snap and lock actions of the electric switch are described below with reference to FIGS. 32-49.

Figure 32:
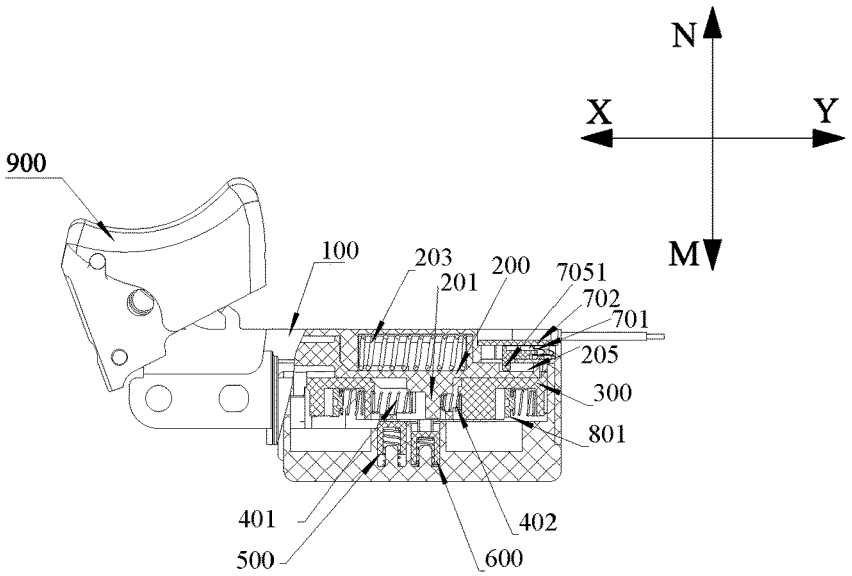
FIG. 32 is a schematic diagram of the electric switch in an initial state according to another embodiment of the present disclosure.
Figure 33:
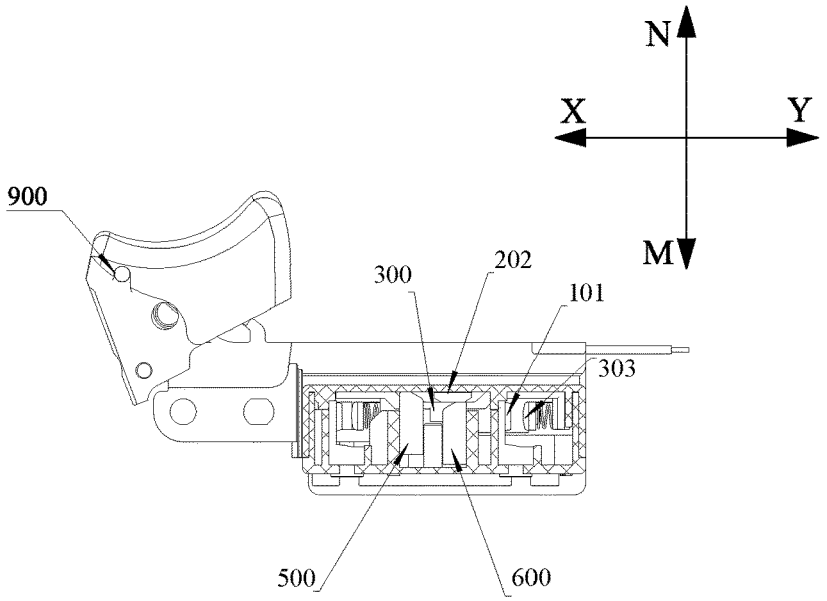
FIG. 33 is another schematic diagram of the electric switch in the initial state according to another embodiment of the present disclosure.
Figure 34:
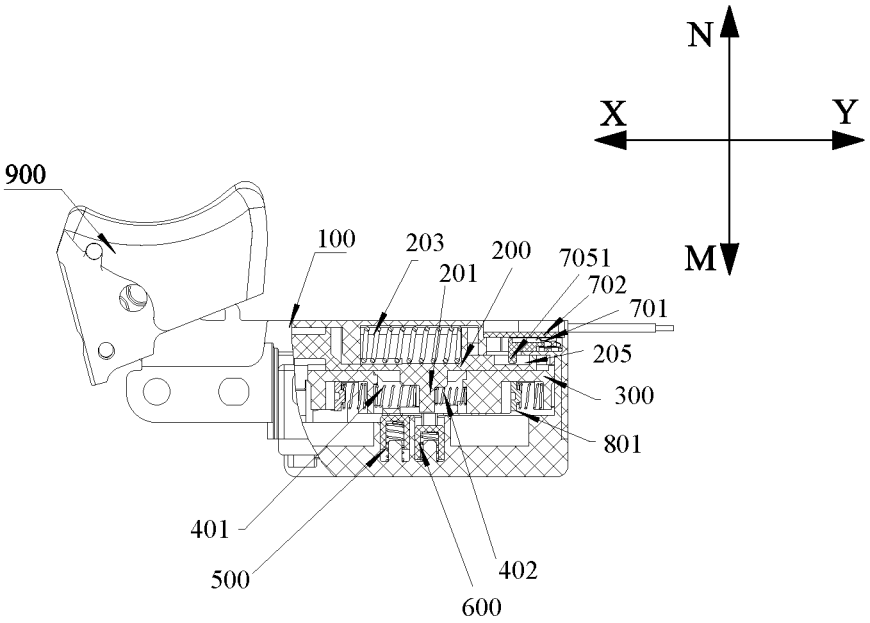
FIG. 34 is a schematic diagram of the electric switch in a first motion state according to another embodiment of the present disclosure.
Figure 35:
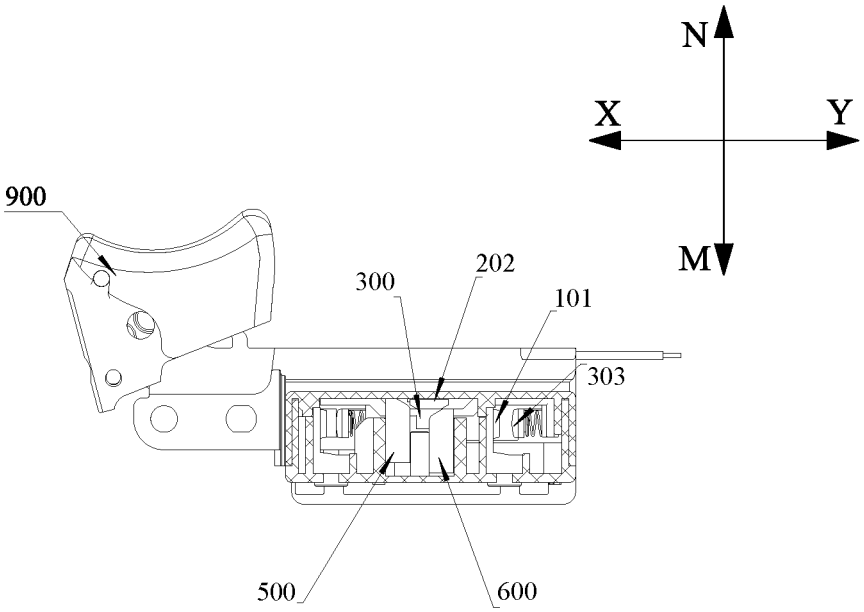
FIG. 35 is another schematic diagram of the electric switch in the first motion state according to another embodiment of the present disclosure.
Figure 36:
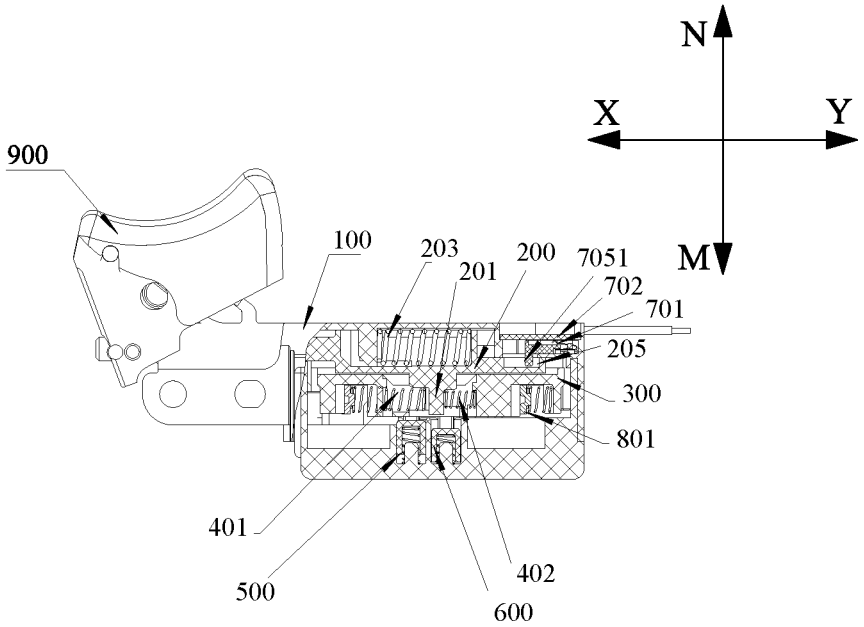
FIG. 36 is a schematic diagram of the electric switch in a second motion state according to another embodiment of the present disclosure.
Figure 37:
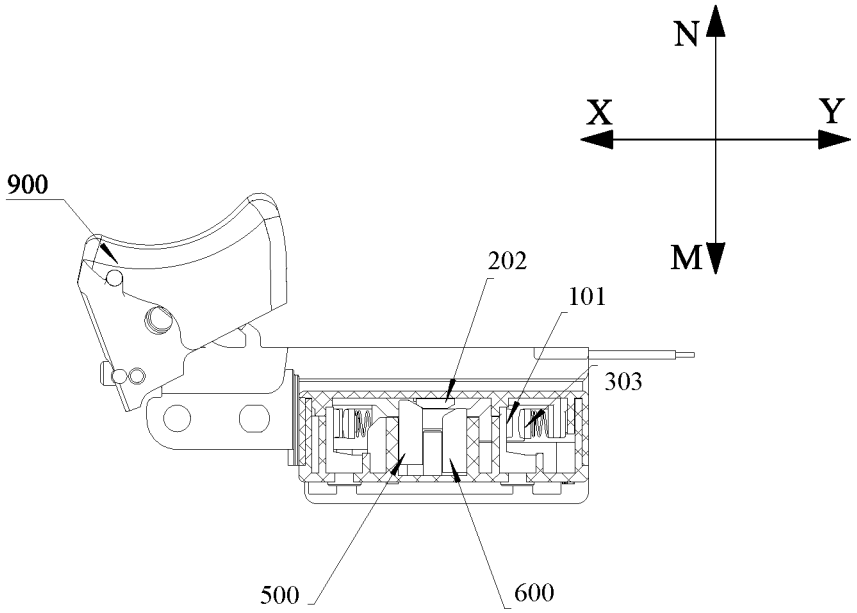
FIG. 37 is another schematic diagram of the electric switch in the second motion state according to another embodiment of the present disclosure.

Referring to FIGS. 4, 32 and 33, the electric switch is in the initial state, and the first lock member 500 does not play a locking role. The unlock portion b of the first lock member 500 abuts on the top of the mounting cavity 1000, and the unlock portion b of the second lock member 600 abuts on the plane of the abutting portion 202 of the actuator 200. The first spring 401 is located in the movable contact frame 300, and two ends of the first spring 401 abut on the first abutment surface 3011 and the second abutment surface 3012, respectively. One end of the second spring 402 abuts on the third abutment surface 3013 of the movable contact frame 300, and the other end of the second spring 402 abuts on the drive portion 201 of the actuator 200. For the signal switch 700, the protrusion 7051 is not in contact with the right inner side wall of the second groove 205.

Referring to FIGS. 4, 20, 34 and 35, when the button 900 is pressed, the actuator 200 is driven to move in the positive direction of the first direction. The drive portion 201 of the actuator 200 is located between the second abutment surface 3012 and the fourth abutment surface 3014 of the movable contact frame 300, and the first spring 401 and the second spring 402 are located in the movable contact frame 300. The drive portion 201 of the actuator 200 does not compress the first spring 401 and the second spring 402. The unlock portion b of the first lock member 500 still abuts on the top of the mounting cavity 1000, and the abutting portion 202 of the actuator 200 starts to move away from the second lock member 600 and approach the first lock member 500. The movable contact frame 300 is still in the initial state and has not moved. For the signal switch 700, the protrusion 7051 is displaced in the second groove 205, and the position of the protrusion 7051 changes, but it still does not contact the right inner side wall of the second groove 205.

Referring to FIGS. 4, 20, 36 and 37, when the button 900 is continuously pressed, the actuator 200 is driven to move in the positive direction of the first direction. The drive portion 201 of the actuator 200 contacts and interacts with the first spring 401 in the movable contact frame 300, the movable contact frame 300 is driven to move in the positive direction of the first direction. When the movable contact frame 300 moves for a certain displacement, the retaining portion 302 of the movable contact frame 300 abuts on the lock portion a of the first lock member 500. At this time, the first lock member 500 locks the movable contact frame 300, and the movable contact frame 300 is not capable of moving. The drive portion 201 of the actuator 200 is located between the second abutment surface 3012 and the fourth abutment surface 3014 of the movable contact frame 300. The first spring 401 and the second spring 402 are located in the movable contact frame 300. The drive portion 201 of the actuator 200 does not compress the first spring 401 and the second spring 402. For the signal switch 700, the protrusion 7051 is displaced in the second groove 205, and the position of the protrusion 7051 changes, but it still does not contact the right inner side wall of the second groove 205.

Figure 38:
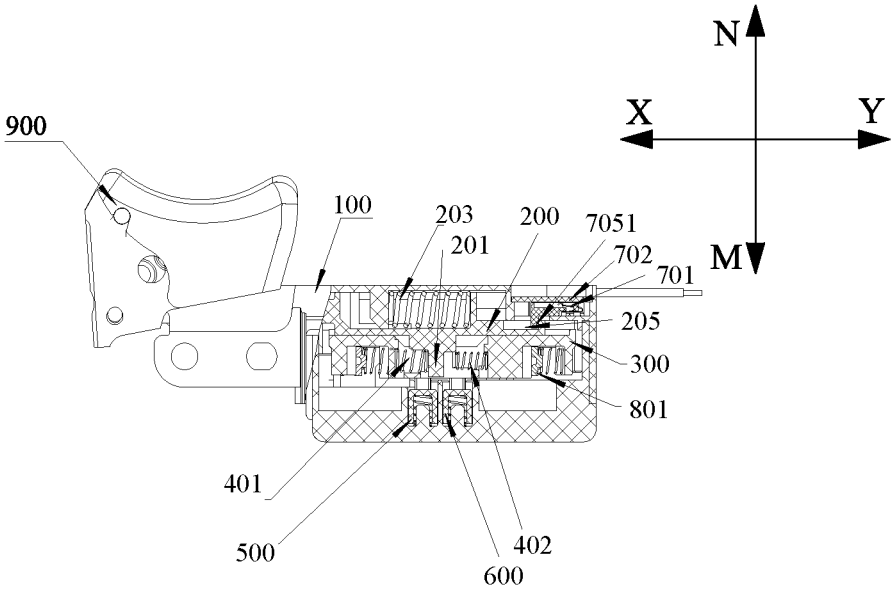
FIG. 38 is a schematic diagram of the electric switch in a third motion state according to another embodiment of the present disclosure.
Figure 39:
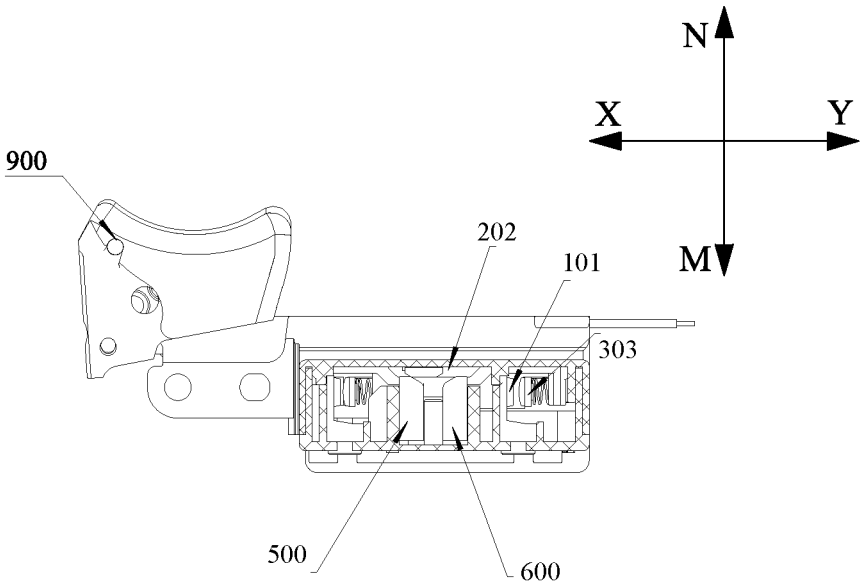
FIG. 39 is another schematic diagram of the electric switch in the third motion state according to another embodiment of the present disclosure.

Referring to FIGS. 20, 38 and 39, when the button 900 is continuously pressed, the actuator 200 is driven to move in the positive direction of the first direction. Since the movable contact frame 300 is locked by the first lock member 500, the movable contact frame 300 does not move. The first spring 401 in the movable contact frame 300 is compressed by the drive portion 201 for energy storage. The unlock portion b of the first lock member 500 is pressed by the front slope of the abutting portion 202 of the actuator 200 and moves in the positive direction of the second direction until the critical state of unlocking is reached. For the signal switch 700, the protrusion 7051 is displaced in the actuation groove 205, the position of the protrusion 7051 changes, and the protrusion 7051 just contacts the right inner side wall of the second groove 205.

Figure 40:
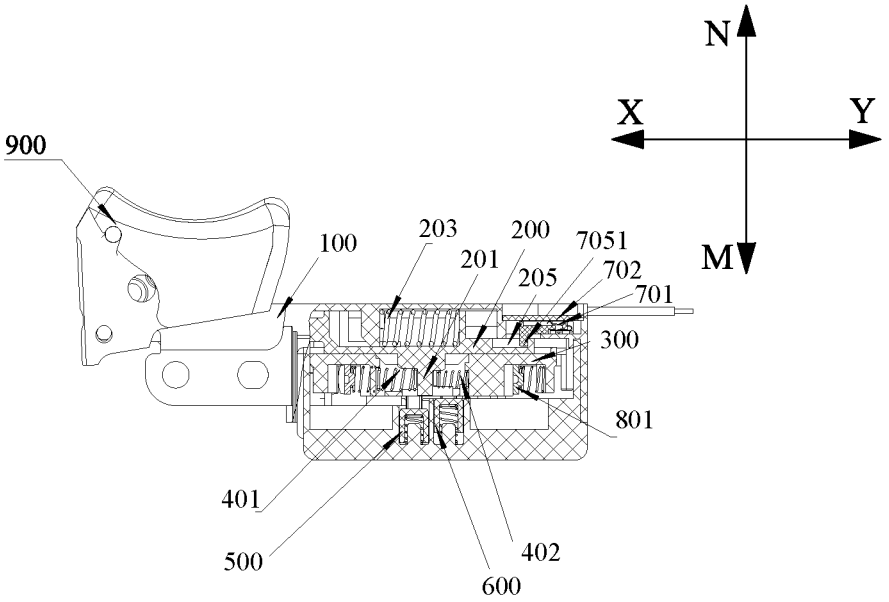
FIG. 40 is a schematic diagram of the electric switch in a fourth motion state according to another embodiment of the present disclosure.
Figure 41:
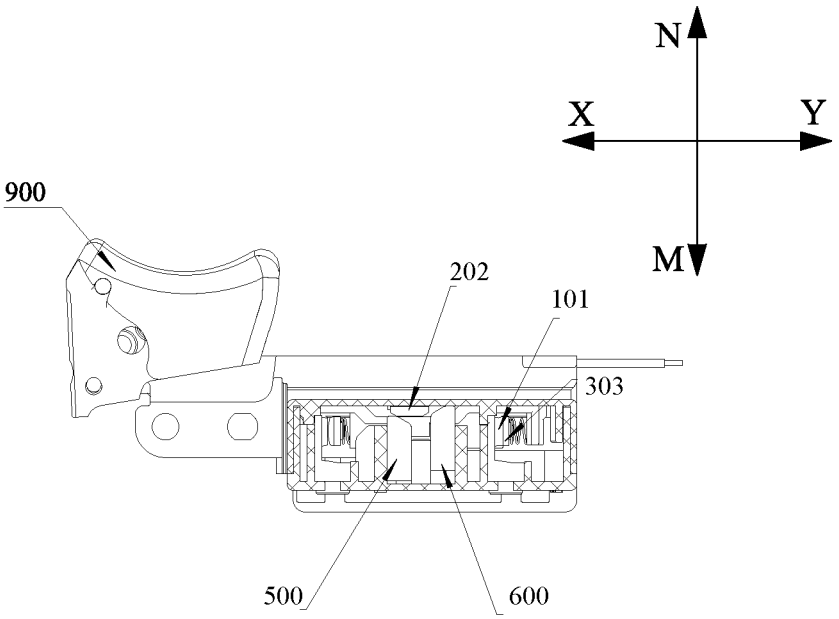
FIG. 41 is another schematic diagram of the electric switch in the fourth motion state according to another embodiment of the present disclosure.

Referring to FIGS. 20, 40 and 41, when the button 900 is continuously pressed, the actuator 200 continues to move in the positive direction of the first direction. The protrusion 7051 is in contact with the right side wall of the second groove 205, and the protrusion 7051 is driven to move under the movement of the actuator 200, thereby driving the brush 701 to slide on the circuit board 702 and contact the conductive sheet on the circuit board 702 to switch on the signal switch 700. The unlock portion b of the first lock member 500 is pressed by the abutting portion 202 of the actuator 200, and the first lock member 500 moves in the positive direction of the second direction to unlock the movable contact frame 300. The first spring 401 immediately produces a snap action to release energy, and the movable contact frame 300 moves rapidly in the positive direction of the first direction. The movable contact 801 contacts the fixed contact 802, causing the contact switch 800 to be switched on instantaneously. When the movable contact frame 300 rapidly moves in the positive direction of the first direction, the second lock member 600 moves in the negative direction of the second direction under the action of the reset portion c to lock the movable contact frame 300. This ensures the reliable connection between the movable contact 801 and the fixed contact 802 and the reliable connection between the brush 701 and the conductive sheet on the circuit board 702, avoiding the burning of the contacts caused by the bounce, the shaking or the undesirable phenomenon of non-communication of contacts, thus prolonging the service life of the electric switch.

Figure 42:
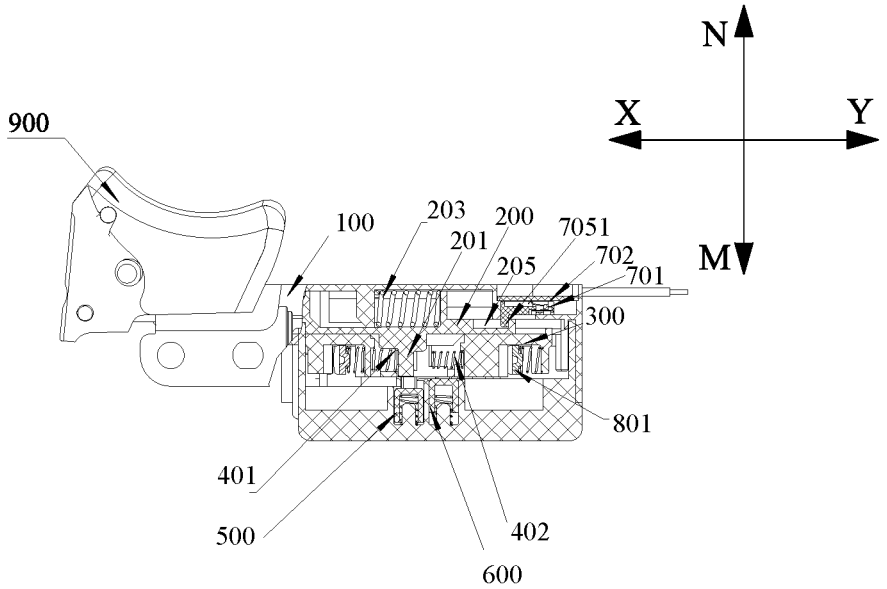
FIG. 42 is a schematic diagram of the electric switch in a fifth motion state according to another embodiment of the present disclosure.
Figure 43:
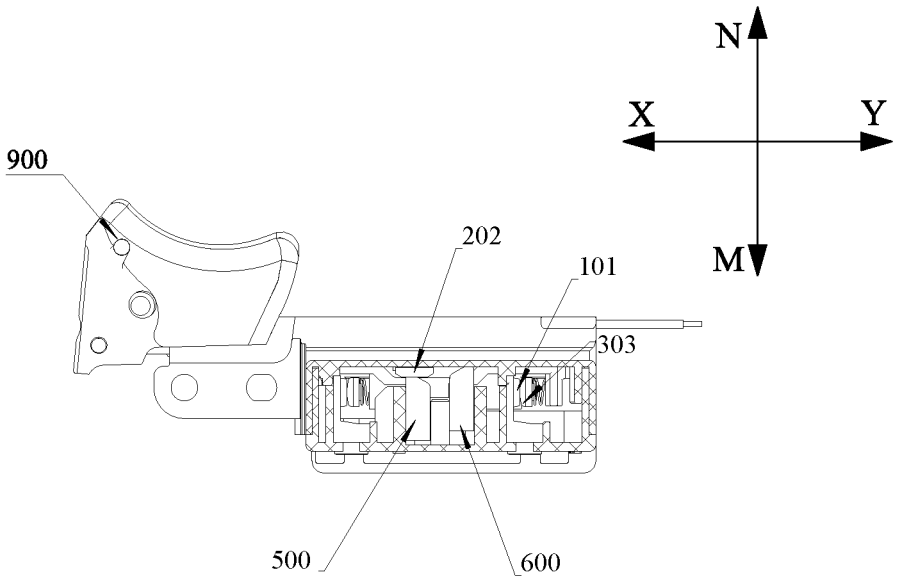
FIG. 43 is another schematic diagram of the electric switch in the fifth motion state according to another embodiment of the present disclosure.
Figure 44:
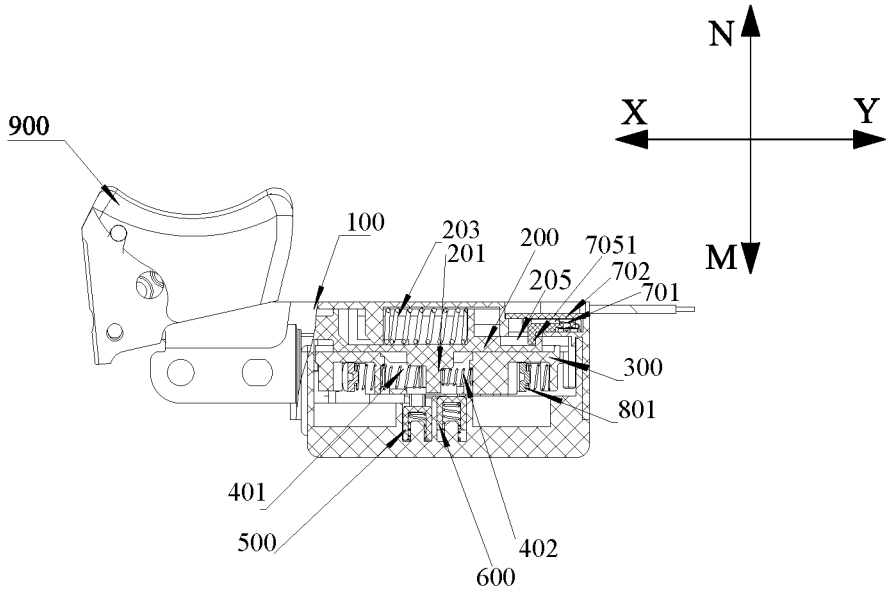
FIG. 44 is a schematic diagram of the electric switch in a sixth motion state according to another embodiment of the present disclosure.
Figure 45:
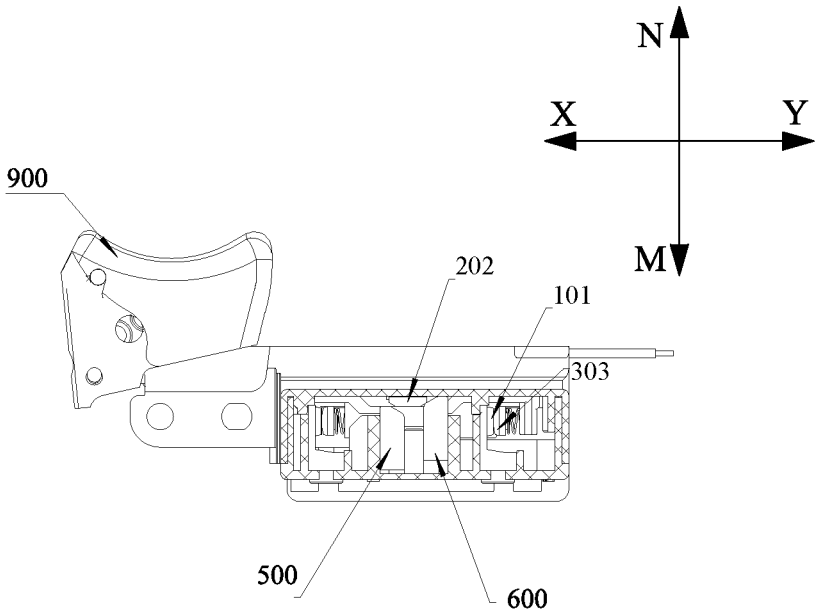
FIG. 45 is another schematic diagram of the electric switch in the sixth motion state according to another embodiment of the present disclosure.

Referring to FIGS. 20, 42 and 43, when the button 900 is continuously pressed, the actuator 200 continues to move in the positive direction of the first direction, and the first spring 401 is compressed by the drive portion 201 of the actuator 200 to store energy. At this time, the first lock member 500 is in an unlocked state, and the second lock member 600 still locks the movable contact frame 300, and the contact switch 800 and the signal switch 700 are still in an on state.

Referring to FIGS. 4, 20, 44 and 45, the button 900 is released, and the actuator 200 moves in the negative direction of the first direction under the action of the elastic force of the reset element 203 and the first spring 401. The drive portion 201 is located between the second abutment surface 3012 and the fourth abutment surface 3014 of the movable contact frame 300, and the second spring 402 is not compressed for the energy storage by the drive portion 201. The rear slope of the abutting portion 202 abuts on the first slope s1 of the second lock member 600, and the second lock member 600 still locks the movable contact frame 300. The contact switch 800 and the signal switch 700 are still in the on state.

Figure 46:
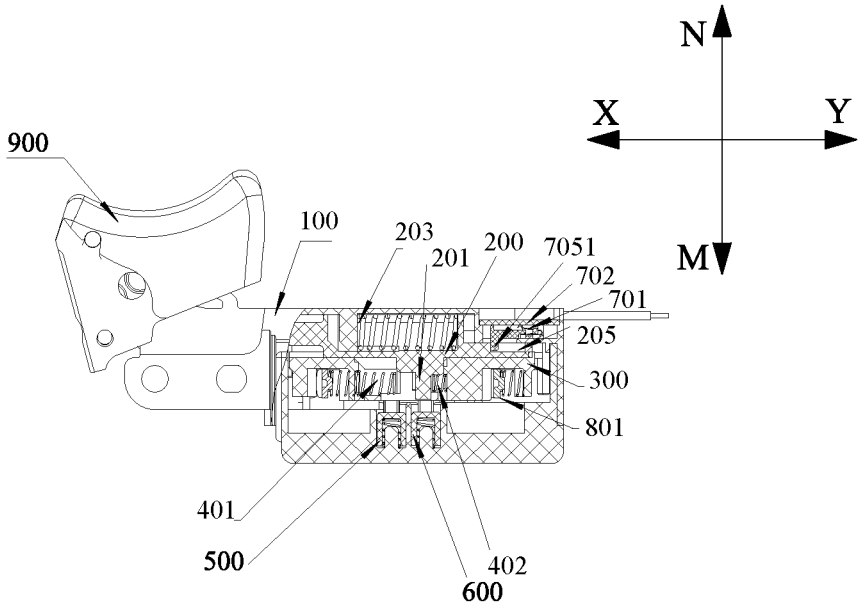
FIG. 46 is a schematic diagram of the electric switch in a seventh motion state according to another embodiment of the present disclosure.
Figure 47:
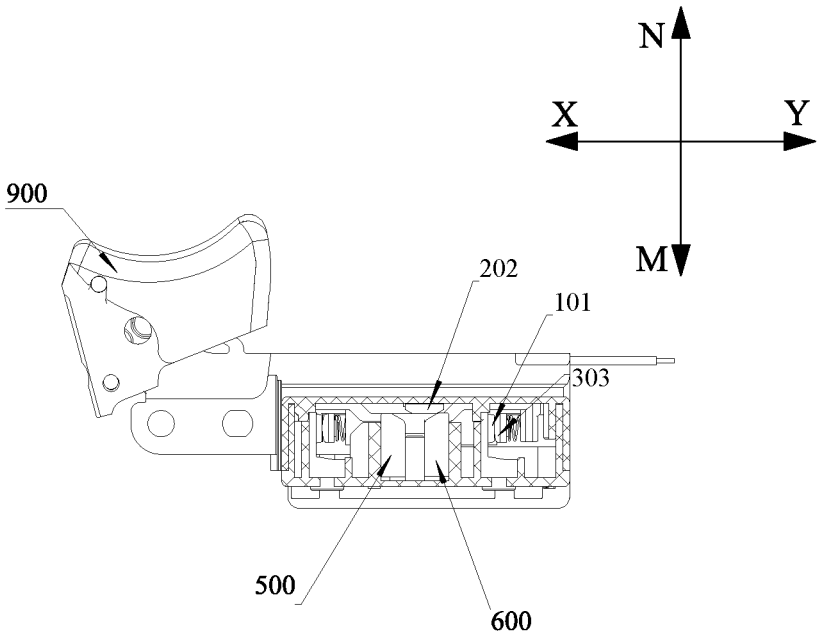
FIG. 47 is another schematic diagram of the electric switch in the seventh motion state according to another embodiment of the present disclosure.
Figure 48:
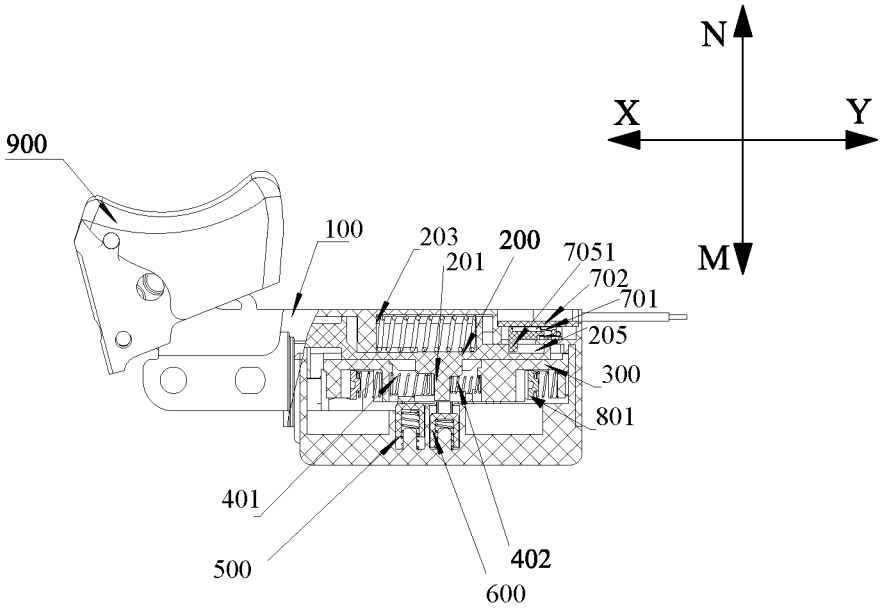
FIG. 48 is a schematic diagram of the electric switch in an eighth motion state according to another embodiment of the present disclosure.
Figure 49:
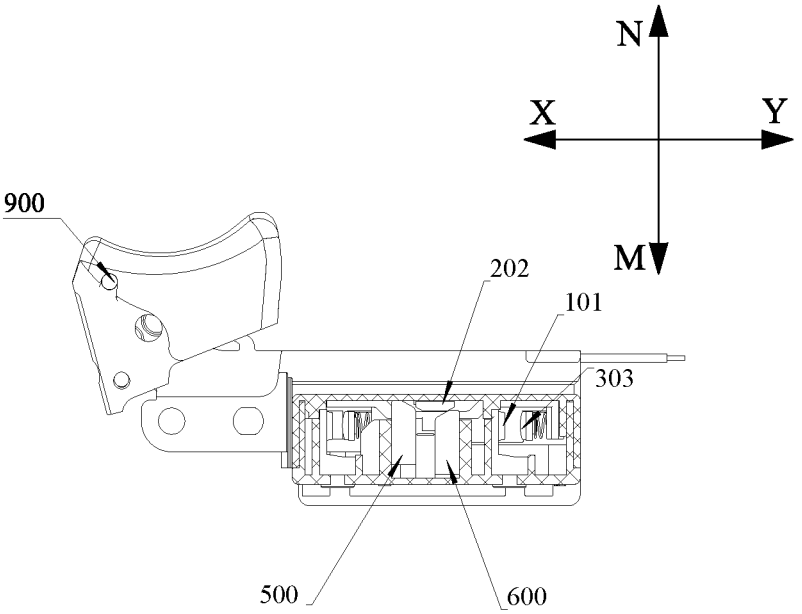
FIG. 49 is another schematic diagram of the electric switch in the eighth motion state according to another embodiment of the present disclosure.

Referring to FIGS. 20, 46 and 47, when the button 900 is released, the actuator 200 continues to move in the negative direction of the first direction. Since the second lock member 600 locks the movable contact frame 300, the drive part 201 compresses the second spring 402 for energy storage. The unlock portion b of the second lock member 600 is pressed by the rear slope of the abutting portion 202 of the actuator 200 and moves in the positive direction of the second direction until the critical state of unlocking is reached. For the signal switch 700, the protrusion 7051 is displaced in the second groove 205, and the position of the protrusion 7051 changes, and the protrusion 7051 contacts the left inner side wall of the second groove 205.

Referring to FIGS. 4, 20, 48 and 49, when the button 900 is released, the actuator 200 drives the brush 701 to reset, and the signal switch 700 is switched off instantaneously. The second lock member 600 is unlocked, and the second spring 402 suddenly releases energy to drive the movable contact frame 300 to move rapidly in the negative direction of the first direction, so that the contact switch 800 is switched off instantaneously. When the movable contact frame 300 rapidly moves in the negative direction of the first direction, the lock portion a of the first lock member 500 moves upward under the action of the reset portion c and abuts the retaining portion 302 of the movable contact frame 300 for locking the movable contact frame 300 until the button returns to the initial position. At this time, the electric switch returns to the initial state.

In some embodiments, some structures of the electric switch can adopt existing structures, which will not be described in detail herein.

In the description of the present disclosure, it should be understood that the directions and position relationship indicated by the terms such as "center", "longitudinal", "transverse", "length", "width", "thickness", "upper", "lower", "front", "rear", "left", "right", "vertical", "horizontal", "top", "bottom", "inner", "outer", "clockwise", "counterclockwise" are based on the orientation or position relationship shown in the drawings, which is only for the convenience of describing the present invention and simplifying the description, and does not indicate or imply that the device or element referred to must have a specific orientation and be constructed and operated in a specific orientation. Therefore, such terms should not be understood as a limitation to the present disclosure.

In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of the present invention, unless specified, the term "plurality" means two or more.

In the present disclosure, unless specified, the terms such as "mount", "connect", "link", "fix" should be understood in a broad sense. For example, "connect" may result in a fixed connection, a detachable connection, or an integrated configuration of elements. The elements may be connected mechanically or electrically; or directly connected or indirectly connected through an intermediate medium. Alternatively, two elements may be in communication or interact with each other unless specified. For the skilled in the art, the specific meanings of the above terms in the present invention can be understood according to specific conditions.

In the present disclosure, unless specified, when a first feature is located "above" or "below" the second feature, the first and second features may contact each other in a direct manner or through another feature located therebetween. Moreover, terms "on", "above" and "over" indicate that the second feature is directly above or obliquely above the second feature, or simply mean that the level of the first feature is higher than that of the second feature. Terms "under", "below" and "beneath" indicate that the second feature is directly below or obliquely below the second feature, or simply mean that the level of the first feature is lower than that of the second feature.

In the description of the present disclosure, terms "an embodiment", "some embodiments", "examples", "some examples", or "some examples" etc. indicate that the specific feature, structure, material or characteristic described in combination with the embodiment or example is included in at least one embodiment or example of the present disclosure. These terms should not be understood as necessarily referring to the same embodiment or example. Moreover, the described specific features, structures, materials or characteristics can be combined in any one or more embodiments or examples in a proper manner. In addition, different embodiments or examples described herein can be combined by those skilled in the art.

Although the above description has illustrated some embodiments of the present disclosure, it should be understood that the above embodiments are exemplary and should not be construed as limiting the scope of the present disclosure. Changes, modifications and replacements can be made by those of ordinary skill in the art based on the above-mentioned embodiments within the scope of the present disclosure.

What is claimed is:

1. An electric switch, comprising: a casing; wherein a mounting cavity is provided in the casing; and an actuator, a movable contact frame, a snap-action resilient member, a lock mechanism, a contact switch and a signal switch are provided in the mounting cavity;

the actuator is capable of reciprocating in the mounting cavity along a first direction;

the movable contact frame is provided with a retaining portion;

the snap-action resilient member is arranged in the movable contact frame, and is configured to be compressed by the actuator with movement of the actuator;

the lock mechanism comprises a first lock member and a second lock member; and the first lock member and the second lock member are configured to reciprocate in the mounting cavity with the movement of the actuator in a second direction to lock or unlock the retaining portion;

the signal switch comprises a brush and a circuit board; the brush is arranged on the movable contact frame, and the circuit board is arranged in the mounting cavity;

the contact switch comprises a movable contact and a fixed contact; the movable contact is arranged on the movable contact frame, and the fixed contact is arranged in the mounting cavity;

when the actuator is driven to move along the first direction, the first lock member locks the retaining portion, and the second lock member does not lock the retaining portion, and the snap-action resilient member is compressed by the actuator for energy storage; when the actuator is driven to continuously move along the first direction, the first lock member unlocks the retaining portion, and the snap-action resilient member produces a snap action to release energy to drive the movable contact frame to move, so that the brush is driven to slide on the circuit board to switch on/off the signal switch; at the same time, the movable contact is driven to move close to or away from the fixed contact, so that the movable contact is in contact with or separated from the fixed contact, allowing the contact switch to be switched on/off; during the movement of the movable contact frame, the second lock member locks the retaining portion.

2. The electric switch of claim 1, wherein the actuator comprises a drive portion and an abutting portion connected to the drive portion; the abutting portion is capable of moving with the drive portion; the drive portion is inserted into the movable contact frame and moves with the actuator; the drive portion is capable of compressing the snap-action resilient member to allow the snap-action resilient member to store energy; and the abutting portion is capable of abutting against the first lock member or the second lock member to drive the first lock member or the second lock member to unlock the retaining portion.

3. The electric switch of claim 2, wherein the snap-action resilient member comprises a first spring and a second spring which are respectively arranged at two sides of the drive portion; the first spring is able to be compressed by one side of the drive portion for energy storage, and the second spring is able to be compressed by the other side of the drive portion for energy storage.

4. The electric switch of claim 1, wherein each of the first lock member and the second lock member comprises a lock portion, an unlock portion and a reset portion; one end of the reset portion abuts in the mounting cavity, and the reset portion is able to be compressed when subjected to a compression force exerted by the actuator in the second direction; when the compression force is removed, the reset portion has a reset force which is in the second direction and opposite to the compression force; the reset force allows the lock portion to move along the second direction and lock the retaining portion to limit the movement of the movable contact frame; the unlock portion is pressed by the actuator to overcome the reset force of the reset portion to allow the lock portion to be detached from the retaining portion.

5. The electric switch of claim 1, further comprising:

a first terminal; and a second terminal;

wherein the circuit board is mounted in the mounting cavity through the first terminal, and the fixed contact is mounted in the mounting cavity through the second terminal.

6. The electric switch of claim 5, wherein the circuit board is electrically connected to the first terminal through a first resilient element; or the circuit board and the first terminal are riveted.

7. The electric switch of claim 5, wherein the first terminal is provided with a first counterbore, and in the first counterbore, the first terminal is connected to a first external conductor through a first locking screw; the second terminal is provided with a second counterbore; and in the second counterbore, the second terminal is connected to a second external conductor through a second locking screw.

8. The electric switch of claim 1, wherein a first mounting slot and a second mounting slot are respectively arranged on two sides of the retaining portion of the movable contact frame; the brush is arranged in the first mounting slot, and the movable contact is arranged in the second mounting slot.

9. An electric switch, comprising:

a casing;

wherein a mounting cavity is provided in the casing; and an actuator, a movable contact frame, a snap-action resilient member, a lock mechanism, a contact switch and a signal switch are provided in the mounting cavity;

the actuator is capable of reciprocating in the mounting cavity along a first direction;

the movable contact frame is provided with a retaining portion;

the snap-action resilient member is arranged in the movable contact frame, and is configured to be compressed by the actuator with movement of the actuator;

the lock mechanism comprises a first lock member and a second lock member; and the first lock member and the second lock member are configured to reciprocate in the mounting cavity with the movement of the actuator in a second direction to lock or unlock the retaining portion;

the signal switch comprises a brush and a circuit board; the brush is connected to the actuator, so that the actuator drives the brush to move; and the circuit board is arranged on the casing;

the contact switch comprises a movable contact and a fixed contact; the movable contact is arranged on the movable contact frame, and the fixed contact is arranged in the mounting cavity;

when the actuator is driven to move along the first direction, the first lock member locks the retaining portion, and the second lock member does not lock the retaining portion, and the snap-action resilient member is compressed by the actuator for energy storage; when the actuator is driven to continuously move along the first direction, the first lock member unlocks the retaining portion, and the snap-action resilient member produces a snap action to release energy to drive the movable contact frame to move; the movable contact is driven to move close to or away from the fixed contact, so that the movable contact is in contact with or separated from the fixed contact, allowing the contact switch to be switched on/off; the brush is driven by the actuator to move on the circuit board to switch on/off the signal switch; and during the movement of the movable contact frame, the second lock member locks the retaining portion.

10. The electric switch of claim 9, wherein the casing is provided with a first groove, and a brush holder is provided in the first groove; and the brush is arranged on the brush holder, and the actuator is provided with a second groove; the brush holder is inserted into the second groove, so that the brush holder is driven to move in the first groove through an inner side wall of the second groove.

11. The electric switch of claim 10, wherein a hanger is provided in the first groove; and the circuit board is arranged at the casing through the hanger and is sealed by a resin.

* * * * *